US011615750B2

(12) United States Patent
An

(10) Patent No.: US 11,615,750 B2
(45) Date of Patent: Mar. 28, 2023

(54) DISPLAY DEVICE AND METHOD OF DRIVING THE SAME

(71) Applicant: Samsung Display Co., LTD., Yongin-si (KR)

(72) Inventor: Boyoung An, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/732,509

(22) Filed: Apr. 28, 2022

(65) Prior Publication Data

US 2022/0366857 A1 Nov. 17, 2022

(30) Foreign Application Priority Data

May 14, 2021 (KR) ..... 10-2021-0062778

(51) Int. Cl.
*G09G 3/3291* (2016.01)

(52) U.S. Cl.
CPC ... *G09G 3/3291* (2013.01); *G09G 2300/0842* (2013.01); *G09G 2310/0272* (2013.01); *G09G 2320/0233* (2013.01)

(58) Field of Classification Search
None
See application file for complete search history.

(56) References Cited

U.S. PATENT DOCUMENTS

| | | | | |
|---|---|---|---|---|
| 7,924,041 | B2 | 4/2011 | No et al. | |
| 9,230,472 | B2 | 1/2016 | Bae | |
| 9,953,583 | B2 | 4/2018 | Yoon et al. | |
| 10,242,623 | B2 | 3/2019 | Han | |
| 2009/0207333 | A1* | 8/2009 | No | G02F 1/136259 349/54 |
| 2016/0203764 | A1* | 7/2016 | In | G09G 3/3291 345/215 |
| 2017/0103702 | A1* | 4/2017 | Bi | G09G 3/006 |
| 2018/0322844 | A1* | 11/2018 | Lee | G09G 5/10 |

FOREIGN PATENT DOCUMENTS

| | | |
|---|---|---|
| KR | 10-1448006 | 10/2014 |
| KR | 10-1470688 | 12/2014 |
| KR | 10-2017-0081094 | 7/2017 |
| KR | 10-2020-0064549 | 6/2020 |

* cited by examiner

*Primary Examiner* — Sepehr Azari
(74) *Attorney, Agent, or Firm* — H.C. Park & Associates, PLC

(57) ABSTRACT

A display device including a display panel including pixels, a data driver configured to apply a data voltage to the pixels, a sensing driver configured to receive a sensing voltage from the pixels, a gate driver configured to apply a gate signal to the pixels, and a driving controller configured to control the gate driver, the sensing driver, and the data driver. The sensing driver generates leakage sensing data for current leakage characteristic of the pixels based on the sensing voltage received in a first sensing period, and generates threshold voltage sensing data for a threshold voltage of a driving transistor of the pixels based on the sensing voltage received in a second sensing period.

19 Claims, 18 Drawing Sheets

DISPLAY DEVICE AND METHOD OF DRIVING THE SAME

CROSS REFERENCE TO RELATED APPLICATION

This application claims priority from and the benefit of Korean Patent Application No. 10-2021-0062778, filed on May 14, 2021, which is hereby incorporated by reference for all purposes as if fully set forth herein.

BACKGROUND

Field

Embodiments of the present inventive concepts relate generally to a display device and a method of driving the display device. More particularly, embodiments of the present inventive concepts relate to a display device compensating for an image data based on sensing data of pixels included in a display panel.

Discussion of the Background

In a display device, even when pixels are manufactured by the same process, a driving transistor and a light emitting element included in the pixels may have different driving characteristics, and the pixels may emit light with different luminance levels. Also, as the driving time of the display device increases, the pixels may be degraded. In order to compensate for non-uniform luminance and degradation of the pixels, the display device may perform a sensing operation for sensing a driving characteristic of the driving transistor included in the pixels (e.g. threshold voltage VTH and/or mobility) and a driving characteristic of the light emitting element. By compensating for image data based on the sensing data generated by the sensing operation, the display device may display an image having uniform luminance. However, since a conventional display device does not consider a current leakage characteristic of the pixels (e.g. inflow and outflow components generated by a parasitic circuit) that affect the sensing data, an error may occur in the sensing data.

The above information disclosed in this Background section is only for understanding of the background of the inventive concepts, and, therefore, it may contain information that does not constitute prior art.

SUMMARY

Embodiments of the present inventive concepts provide a display device compensating for sensing data to reduce a compensation error of image data.

Embodiments of the present inventive concepts also provide a method of driving the display device.

Additional features of the inventive concepts will be set forth in the description which follows, and in part will be apparent from the description, or may be learned by practice of the inventive concepts.

An embodiment of the present inventive concepts provides a display device including a display panel including pixels, a data driver configured to apply a data voltage to the pixels, a sensing driver configured to receive a sensing voltage from the pixels, a gate driver configured to apply a gate signal to the pixels, and a driving controller configured to control the gate driver, the sensing driver, and the data driver. The sensing driver generates leakage sensing data for a current leakage characteristic of the pixels based on the sensing voltage received in a first sensing period, and generates threshold voltage sensing data for a threshold voltage of a driving transistor of the pixels based on the sensing voltage received in a second sensing period.

The driving controller may receive the leakage sensing data and the threshold voltage sensing data from the sensing driver and may compensate for the threshold voltage sensing data based on the leakage sensing data.

The display device may further include a sensing data memory device configured to store the threshold voltage sensing data.

The sensing data memory device may store a total average value of initial leakage sensing data for all of the pixels, and the driving controller may receive the total average value of the initial leakage sensing data, generate leakage data corresponding to a difference between the total average value of the initial leakage sensing data and an individual value of the leakage sensing data for each of the pixels, and compensate for the threshold voltage sensing data based on the leakage data.

The driving controller may not compensate for the threshold voltage sensing data when a difference between the total average value of the initial leakage sensing data and a total average value of the leakage sensing data for all of the pixels is less than a preset reference leakage value.

The threshold voltage sensing data may be compensated by adding an individual value of the leakage data for each of the pixels to an individual value of the threshold voltage sensing data for each of the pixels.

The threshold voltage sensing data may be compensated by adding a product of an individual value of the leakage data for each of the pixels and a leakage gain to an individual value of the threshold voltage sensing data for each of the pixels.

The sensing data memory device may store a total value of initial leakage sensing data for all of the pixels, and the driving controller may receive the total average value of the initial leakage sensing data, generate leakage data corresponding to a difference between the total average value of the initial leakage sensing data and a total average value of the leakage sensing data for all of the pixels, and compensate for the threshold voltage sensing data based on the leakage data.

The sensing data memory device may store initial leakage sensing data, and the driving controller may receive the initial leakage sensing data, generate leakage data corresponding to a difference between an individual value of the initial leakage sensing data for each of the pixels and an individual value of the leakage sensing data for each of the pixels, and compensate for the threshold voltage sensing data based on the leakage data.

The display panel may include sub-blocks, the sensing data memory device may store a total average value of initial leakage sensing data for all of the pixels, and the driving controller may receive the total average value of the initial leakage sensing data, generate leakage data corresponding to a difference between the total average value of the initial leakage sensing data and a sub-block average value of the leakage sensing data for the pixels included in each of the sub-blocks, and compensate for the threshold voltage sensing data based on the leakage data.

The display panel may include sub-blocks, the sensing data memory device may store a sub-block average value of initial leakage sensing data for the pixels included in each of the sub-blocks, and the driving controller may receive the sub-block average value of the initial leakage sensing data, generate leakage data corresponding to a difference between the sub-block average value of the initial leakage sensing data and a sub-block average value of the leakage sensing data for the pixels included in each of the sub-blocks, and compensate for the threshold voltage sensing data based on the leakage data.

Each of the pixels may include a switching transistor configured to transmit the data voltage applied through a data line in response to the gate signal, a storage capacitor configured to store the data voltage transmitted by the switching transistor, the driving transistor configured to generate a driving current based on the data voltage stored in the storage capacitor, a light emitting element configured to emit light based on the driving current generated by the driving transistor, and a sensing transistor configured to connect a connection node between the driving transistor and the light emitting element to a sensing line through which the sensing voltage is transmitted in response to a sensing signal.

The sensing driver may apply a sensing initialization voltage to the connection node through the sensing line in a sensing initialization period of the first sensing period, and the sensing driver may generate the leakage sensing data in a measurement period of the first sensing period.

The sensing driver may apply a reference voltage to a gate electrode of the driving transistor through the data line in the second sensing period, the sensing driver may apply the sensing initialization voltage to the connection node through the sensing line in a sensing initialization period of the second sensing period, and the sensing driver may generate the threshold voltage sensing data in a measurement period of the second sensing period.

The second sensing period may follow the first sensing period.

Another embodiment of the present inventive concepts provides a method of driving a display device including storing a total average value of initial leakage sensing data for all of pixels included in the display device before the pixels are degraded, generating leakage sensing data for a current leakage characteristic of the pixels in a power-off state, generating threshold voltage sensing data for a threshold voltage of a driving transistor included in the pixels in the power-off state, compensating for the threshold voltage sensing data based on the leakage sensing data and the total average value of the initial leakage sensing data in the power-off state, and compensating for input image data based on the threshold voltage sensing data to generate compensated image data in a power-on state.

Compensating for the threshold voltage sensing data may include calculating a difference between an individual value of the leakage sensing data for each of the pixels and the total average value of the initial leakage sensing data to generate leakage data, and adding an individual value of the leakage data for each of the pixels to an individual value of the threshold voltage sensing data for each of the pixels to compensate for the threshold voltage sensing data.

The method may further include comparing a difference between the total average value of the initial leakage sensing data and a total average value of the leakage sensing data for all of the pixels and a preset reference leakage value to generate a comparison result in the power-off state, and determining whether to compensate for the threshold voltage sensing data based on the comparison result.

Determining whether to compensate for the threshold voltage sensing data may include determining to compensate for the threshold voltage sensing data when the difference between the total average value of the initial leakage sensing data and the total average value of the leakage sensing data is greater than the reference leakage value and determining not to compensate for the threshold voltage sensing data when the difference between the total average value of the initial leakage sensing data and the total average value of the leakage sensing data is less than or equal to the reference leakage value.

Compensating for the threshold voltage sensing data may include calculating a difference between an individual value of the leakage sensing data for each of the pixels and the total average value of the initial leakage sensing data to generate leakage data, multiplying an individual value of the leakage data for each of the pixels by a leakage gain, and adding a value obtained by multiplying the individual value of the leakage data by the leakage gain to an individual value of the threshold voltage sensing data for each of the pixels to compensate for the threshold voltage sensing data.

A display device according to the present inventive concepts may sense a current leakage characteristic (e.g. inflow and outflow components generated by a parasitic circuit) of pixels. The display device may compensate error of sensing data for a driving characteristic of a driving transistor included in the pixels (e.g. threshold voltage VTH and/or mobility) and a driving characteristic of a light emitting element, thereby preventing erroneous compensation of input image data caused by the error of the sensing data.

A display device according to the present inventive concepts may divide a display panel into sub-blocks. the display device may store an average value of the sub-blocks of a sensing data, thereby reducing a capacity of the sensing data stored in a sensing data memory device and reducing a size of the display device.

The display device according to the present inventive concepts may multiply a leakage gain by an individual value of leakage data, thereby consistently compensating for threshold voltage sensing data even when sensing condition for the threshold voltage sensing data and sensing condition for the leakage sensing data are different.

It is to be understood that both the foregoing general description and the following detailed description are illustrative and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate illustrative embodiments of the invention, and together with the description serve to explain the inventive concepts.

DETAILED DESCRIPTION OF THE INVENTIVE CONCEPT

Figure 1:
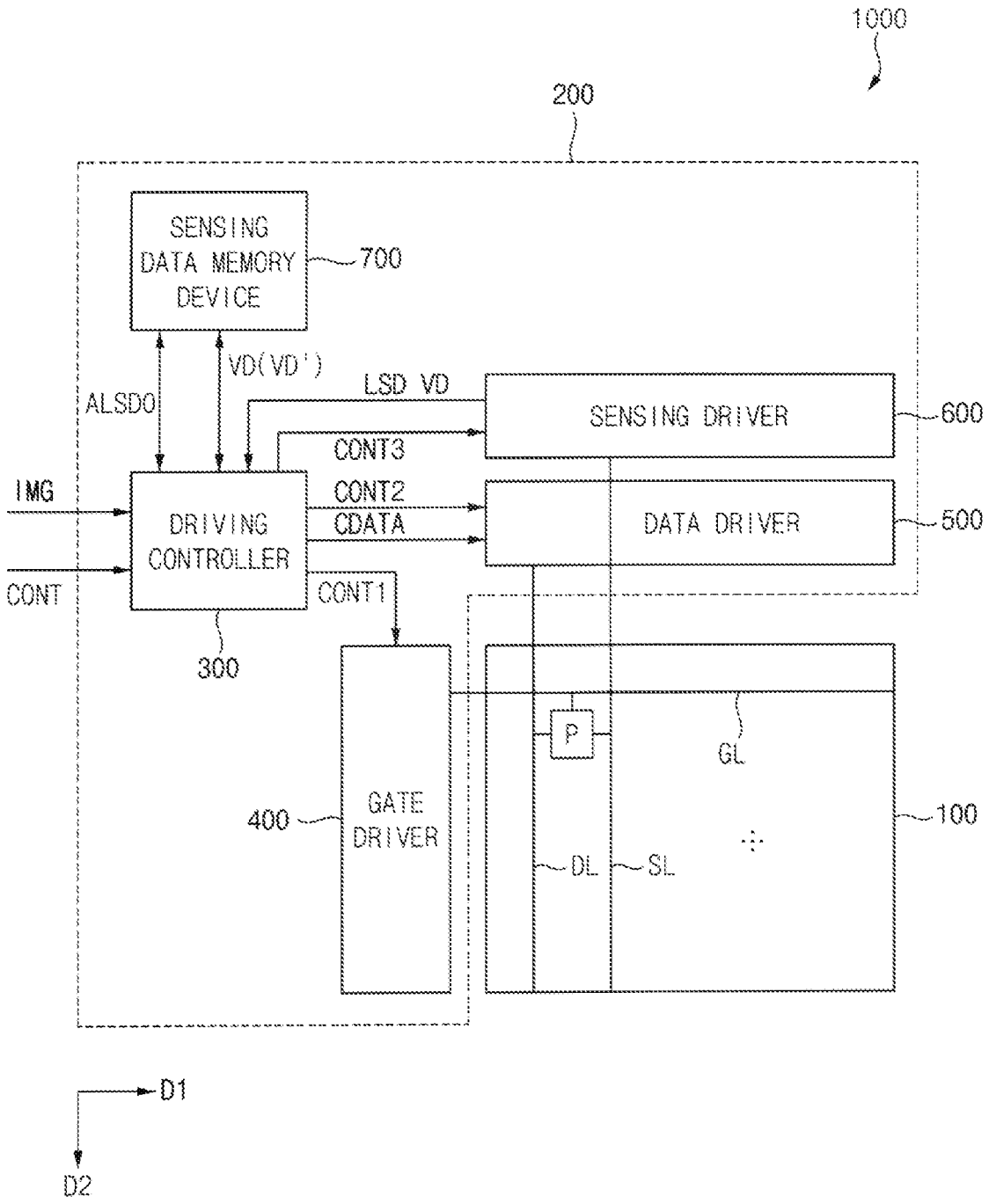
FIG. 1 is a block diagram illustrating a display device according to embodiments of the present inventive concepts.

In the following description, for the purposes of explanation, numerous specific details are set forth in order to provide a thorough understanding of various embodiments or implementations of the invention. As used herein "embodiments" and "implementations" are interchangeable words that are non-limiting examples of devices or methods employing one or more of the inventive concepts disclosed herein. It is apparent, however, that various embodiments may be practiced without these specific details or with one or more equivalent arrangements. In other instances, well-known structures and devices are shown in block diagram form in order to avoid unnecessarily obscuring various embodiments. Further, various embodiments may be different, but do not have to be exclusive. For example, specific shapes, configurations, and characteristics of an embodiment may be used or implemented in another embodiment without departing from the inventive concepts.

Unless otherwise specified, the illustrated embodiments are to be understood as providing illustrative features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As is customary in the field, some embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some embodiments may be physically separated into two or more interacting and discrete blocks, units, and/or modules without departing from the scope of the inventive concepts. Further, the blocks, units, and/or modules of some embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Hereinafter, the present inventive concept will be explained in detail with reference to the accompanying drawings.

FIG. 1 is a block diagram illustrating a display device 1000 according to embodiments of the present inventive concepts.

Referring to FIG. 1, the display device 1000 may include a display panel 100 and a display panel driver 200. The display panel driver 200 may include a driving controller 300, a gate driver 400, a data driver 500, and a sensing driver 600. According to an embodiment, at least two or more of the driving controller 300, the gate driver 400, the data driver 500, and the sensing driver 600 may be integrated into one chip. According to an embodiment, at least two or more of the driving controller 300, the gate driver 400, the data driver 500, the sensing driver 600, and the sensing data memory device 700 may be integrated into one chip.

The display panel 100 may include pixels P electrically connected to a data line DL, a sensing line SL, and a gate line GL. According to an embodiment, the gate line GL may extend in a first direction D1, the data line DL may extend in a second direction D2 crossing the first direction D1, and the sensing line SL may extend in the second direction D2 crossing the first direction D1. According to an embodiment, each of the pixels P may include an organic light emitting diode (OLED), and the display panel 100 may be an OLED display panel.

The driving controller 300 may receive input image data IMG and an input control signal CONT from a host processor (e.g. a graphic processing unit; GPU). For example, the input image data IMG may include red image data, green image data and blue image data. According to an embodiment, the input image data IMG may further include white image data. For another example, the input image data IMG may include magenta image data, yellow image data, and cyan image data. The input control signal CONT may include a master clock signal and a data enable signal. The input control signal CONT may further include a vertical synchronizing signal and a horizontal synchronizing signal.

The driving controller 300 may receive leakage sensing data LSD and threshold voltage sensing data VD from the sensing driver 600. The driving controller 300 may compensate for the threshold voltage sensing data VD based on the leakage sensing data LSD. According to an embodiment, the driving controller 300 may compensate for the threshold voltage sensing data VD based on the leakage sensing data LSD and the total average value ALSD0 of initial leakage sensing data. The driving controller 300 may write compensated threshold voltage sensing data VD' to the sensing data memory device 700. According to an embodiment, when not compensating for the threshold voltage sensing data VD, the driving controller 300 may write the threshold voltage sensing data VD in the sensing data memory device 700 as it is. According to an embodiment, the driving controller 300 may not compensate for the threshold voltage sensing data VD generated when the display device 1000 is manufactured (or before the pixels P is degraded) and write the threshold voltage sensing data VD to the sensing data memory device 700. The driving controller 300 may store the total average value ALSD0 of the initial leakage sensing data LSD0 for all of the pixels P and write the total average value ALSD0 of the initial leakage sensing data to the sensing data memory device 700. The initial leakage sensing data LSD0 may mean leakage sensing data LSD for a current leakage characteristic of the pixels P generated when the display device 1000 is manufactured (or before the pixel P is degraded). The current leakage characteristic may be an inflow and outflow component generated by a parasitic circuit. For example, the current leakage characteristic may mean leakage current generated when the sensing driver 600 receives the sensing voltage VSEN from the pixels P through the sensing line SL. The total average value ALSD0 of the initial leakage sensing data may be a sum of individual values of the initial leakage sensing data LSD0 for each of the pixels P divided by the number of the pixels P.

The driving controller 300 may generate a first control signal CONT1, a second control signal CONT2, a third control signal CONT3, and a data signal DATA based on the input image data IMG, the input control signal CONT, and the threshold voltage sensing data VD (or VD') applied from the sensing data memory device 700 (i.e., it may vary depending on whether the threshold voltage sensing data written in the sensing data memory device 700 is compensated).

The driving controller 300 may generate the first control signal CONT1 for controlling operation of the gate driver 400 based on the input control signal CONT and output the first control signal CONT1 to the gate driver 400. The first control signal CONT1 may include a vertical start signal and a gate clock signal. The driving controller 300 may generate the second control signal CONT2 for controlling operation of the data driver 500 based on the input control signal CONT and output the second control signal CONT2 to the data driver 500. The second control signal CONT2 may include a horizontal start signal and a load signal. The driving controller 300 may generate the third control signal CONT3 for controlling operation of the sensing driver 600 based on the input control signal CONT and output the third control signal CONT3 to the sensing driver 600.

The driving controller 300 may compensate for the input image data IMG based on the threshold voltage sensing data VD (or VD') applied from the sensing data memory 700, and generate the compensated image data CDATA. The driving controller 300 may output the compensated image data CDATA to the data driver 500.

The gate driver 400 may generate a gate signal SS in response to the first control signal CONT1 input from the driving controller 300. The gate driver 400 may output the gate signal SS to the pixels P through the gate line GL.

The data driver 500 may receive the second control signal CONT2 and the compensated image data CDATA from the driving controller 300. The data driver 500 may generate a data voltage DV obtained by converting the compensated image data CDATA into an analog voltage. The data driver 500 may apply the data voltage DV to the pixel P through the data line DL.

The sensing driver 600 may receive the sensing voltage VSEN from the pixel P through the sensing line SL. The sensing driver 600 may generate the leakage sensing data LSD for the current leakage characteristic of the pixels P based on the sensing voltage VSEN. The sensing driver 600 may generate the leakage sensing data LSD for the current leakage characteristic of the pixels P based on the sensing voltage VSEN received in a first sensing period SP1. The sensing driver 600 may generate the threshold voltage sensing data VD for a threshold voltage VTH of a driving transistor T1 of the pixels P based on the sensing voltage VSEN. The sensing driver 600 may generate the threshold voltage sensing data VD for a threshold voltage VTH of a driving transistor T1 of the pixels P based on the sensing voltage VSEN received in a second sensing period SP2. The sensing driver 600 may generate mobility sensing data for mobility of the driving transistor T1 of the pixels P based on the sensing voltage VSEN. The sensing driver 600 may generate light emitting element sensing data for driving characteristic of a light emitting element EL of the pixels P based on the sensing voltage VSEN.

The sensing data memory device 700 may store the threshold voltage sensing data VD (or VD'). According to an embodiment, the sensing data memory device 700 may store the total average value ALSD0 of the initial leakage sensing data. The threshold voltage sensing data VD generated when the display device 1000 is manufactured (or before the pixel P is degraded) may be stored in the sensing data memory device 700 without being compensated. The sensing data memory device 700 may receive the threshold voltage sensing data VD (or VD') from the driving controller 300, and update a previously stored threshold voltage sensing data VD (or VD') to the threshold voltage sensing data VD (or VD') received from the driving controller 300. The threshold voltage sensing data VD (or VD') stored in the sensing data memory device 700 may be periodically or aperiodically updated after driving time of the display device 1000 is increased or the pixel P is degraded.

Figure 2:
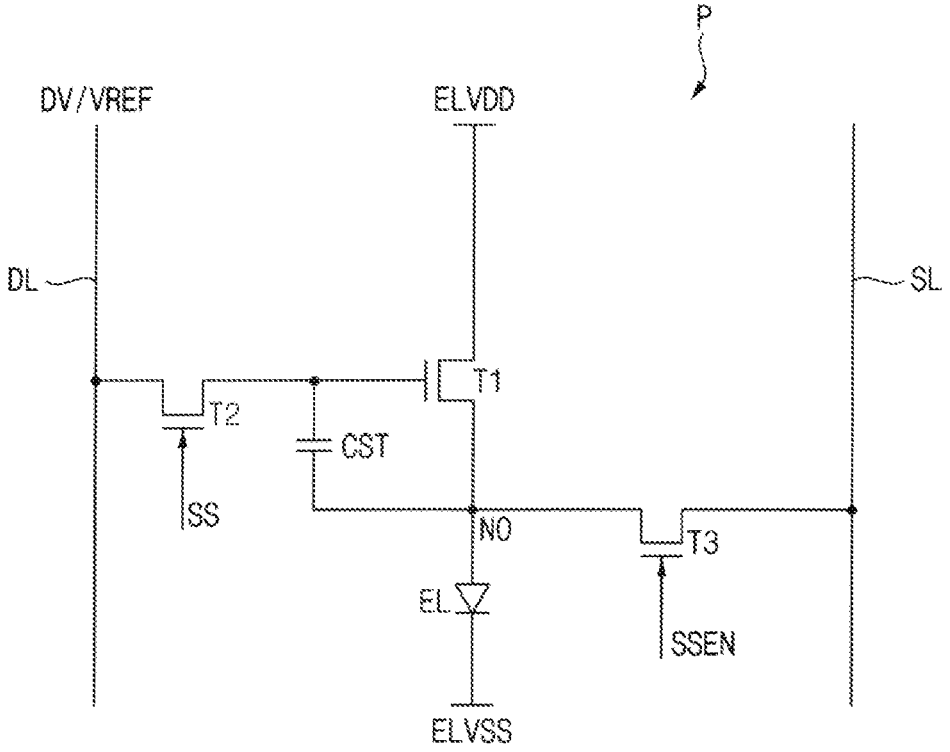
FIG. 2 is a circuit diagram illustrating a pixel included in the display device of FIG. 1.

FIG. 2 is a circuit diagram illustrating the pixel P included in the display device 1000 of FIG. 1.

For example, as shown in FIG. 2, each of the pixels P may include a switching transistor T2 transmitting the data voltage DV applied through the data line DL in response to the gate signal SS, a storage capacitor CST storing the data voltage DV transmitted by the switching transistor T2, the driving transistor T1 generating a driving current based on the data voltage DV stored in the storage capacitor CST, the light emitting element EL emitting light based on the driving current generated by the driving transistor T1, and a sensing transistor T3 connecting a connection node N0 between the driving transistor T1 and the light emitting element EL to the sensing line SL through which the sensing voltage VSEN is transmitted in response to a sensing signal SSEN. According to an embodiment, as shown in FIG. 2, the driving transistor T1, the switching transistor T2, and the sensing transistor T3 may be made as NMOS transistors, but is not limited thereto. Also, the pixels P is not limited to the configuration shown in FIG. 2 and may have various configurations.

Figure 3:
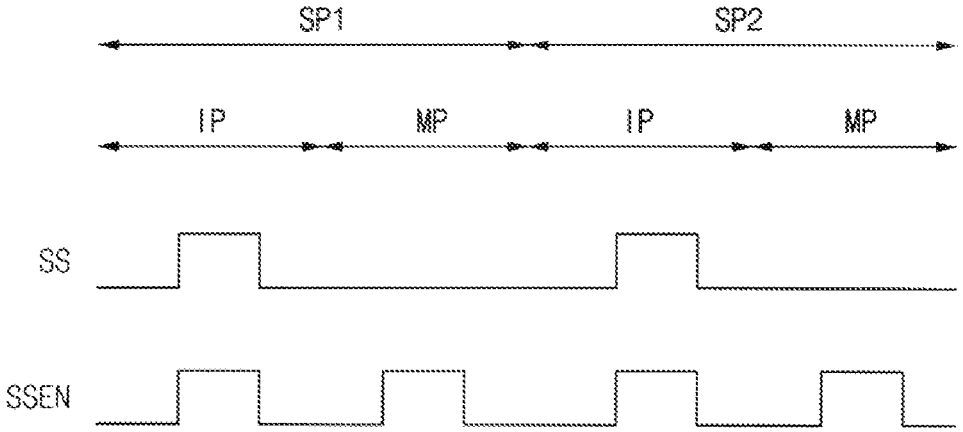
FIG. 3 is a timing diagram illustrating an example in which a gate driver included in the display device of FIG. 1 applies a gate signal and a sensing signal to a pixel.
Figure 4:
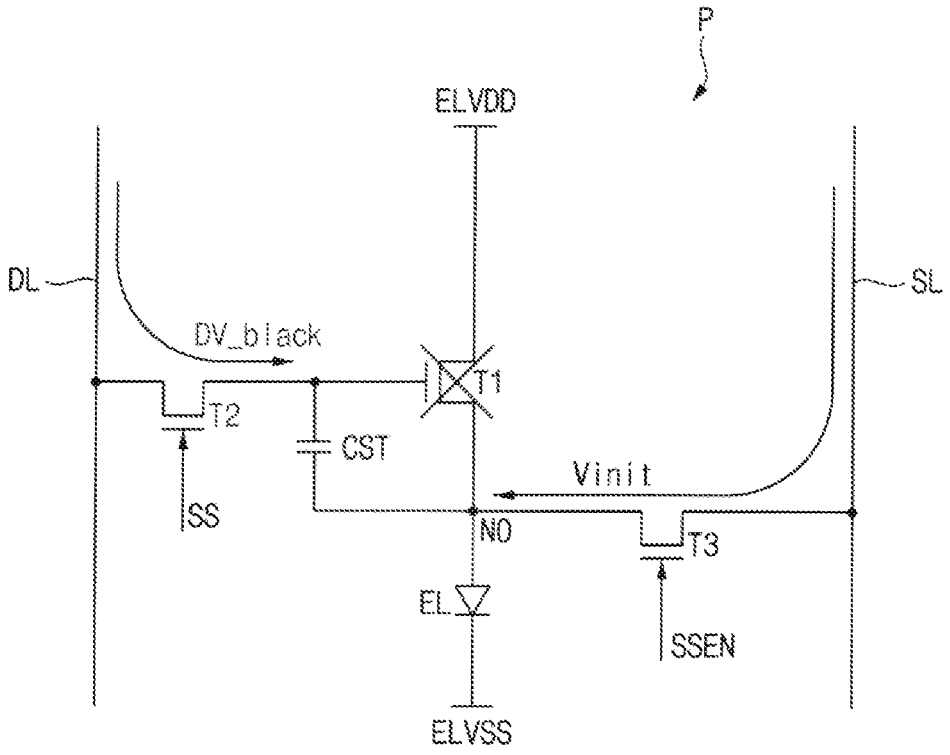
FIG. 4 is a circuit diagram illustrating an example in which a pixel included in the display device of FIG. 1 is driven in a sensing initialization period of a first sensing period.
Figure 5:
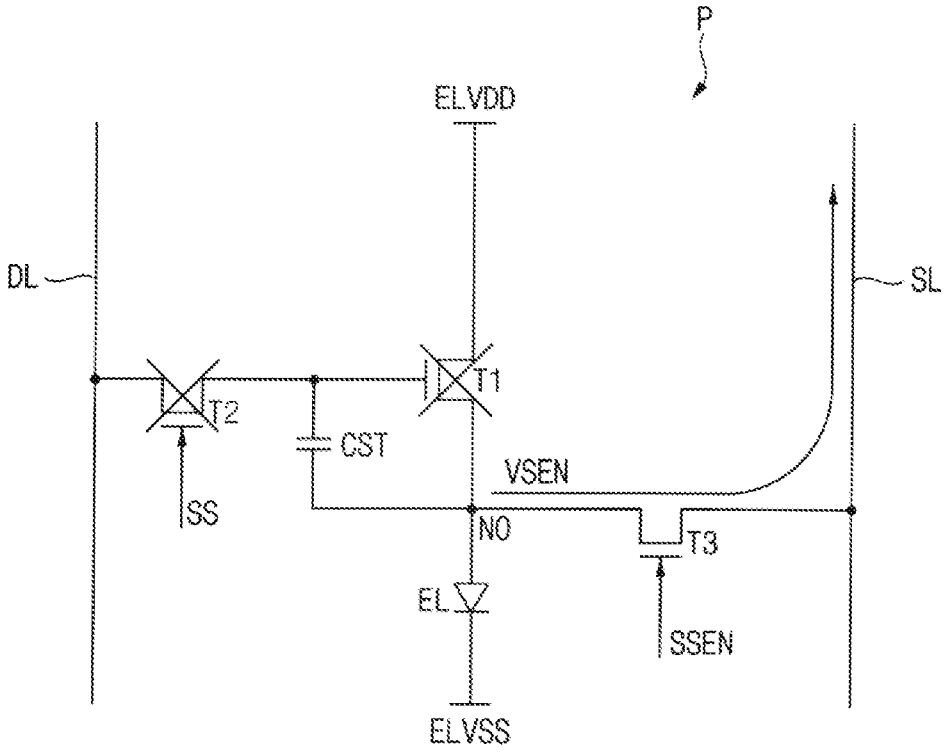
FIG. 5 is a circuit diagram illustrating an example in which a pixel included in the display device of FIG. 1 is driven in a measurement period of a first sensing period.
Figure 6:
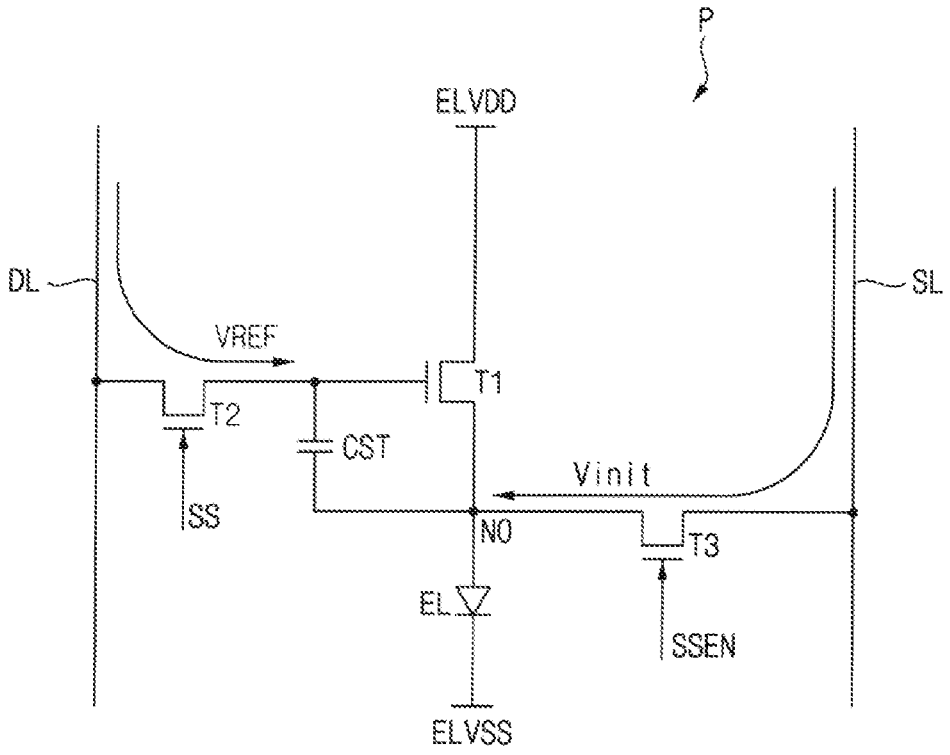
FIG. 6 is a circuit diagram illustrating an example in which a pixel included in the display device of FIG. 1 is driven in a sensing initialization period of a second sensing period.
Figure 7:
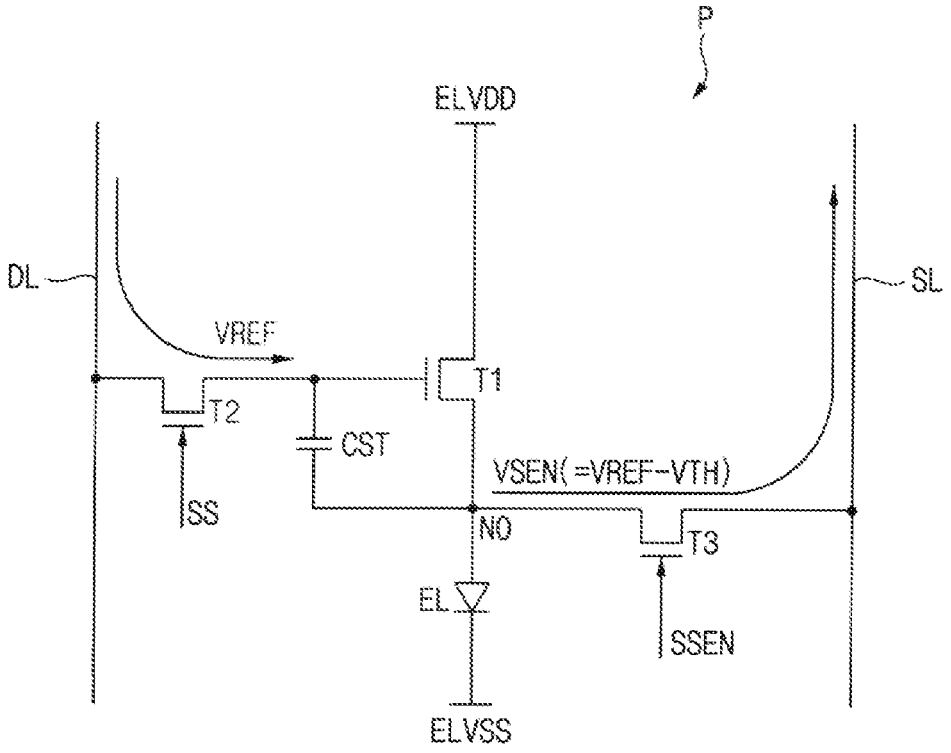
FIG. 7 is a circuit diagram illustrating an example in which a pixel included in the display device of FIG. 1 is driven in a measurement period of a second sensing period.

FIG. 3 is a timing diagram illustrating an example in which the gate driver 400 included in the display device 1000 of FIG. 1 applies the gate signal SS and the sensing signal SSEN to the pixels P. FIG. 3 illustrates timing at which the gate signal SS and/or the sensing signal SSEN have an activation level only once in each sensing initialization period IP and measurement period MP, but is not limited thereto. FIG. 4 is a circuit diagram illustrating an example in which the pixel P included in the display device 1000 of FIG. 1 is driven in the sensing initialization period IP of a first sensing period SP1. FIG. 5 is a circuit diagram illustrating an example in which the pixel P included in the display device 1000 of FIG. 1 is driven in the measurement period MP of the first sensing period SP1. FIG. 6 is a circuit diagram illustrating an example in which the pixel P included in the display device 1000 of FIG. 1 is driven in the sensing initialization period IP of a second sensing period SP2. FIG. 7 is a circuit diagram illustrating an example in which the pixel P included in the display device of FIG. 1 is driven in the measurement period MP of the second sensing period SP2. The first sensing period SP1 and the second sensing period SP2 may be periods while the display apparatus 1000 is in a power-off state.

Referring to FIGS. 3 and 4, according to an embodiment, in the sensing initialization period IP of the first sensing period SP1, the gate signal SS and the sensing signal SSEN may have the activation level. According to an embodiment, in the sensing initialization period IP of the first sensing period SP1, the sensing driver 600 may apply the sensing initialization voltage Vinit to the connection node N0 through the sensing line SL. According to an embodiment, in the sensing initialization period IP of the first sensing period SP1, the data driver 500 may apply the data voltage DV having an off voltage through the data line DL. For example, when the driving transistor T1 is an NMOS transistor, the off voltage may be a data voltage DV_black corresponding to a black grayscale. For example, as shown in FIG. 4, in the sensing initialization period IP of the first sensing period SP1, the switching transistor T2 may be turned on by the gate signal SS having the activation level, the data voltage DV_black corresponding to the black grayscale applied through the data line DL may be written to the storage capacitor CST through the switching transistor T2, the driving transistor T1 may be applied to the data voltage DV_black corresponding to the black grayscale, the sensing transistor T3 may be turned on by the sensing signal SSEN having the activation level, and the sensing initialization voltage Vinit applied through the sensing line SL may be applied to the connection node N0 by the sensing transistor T3.

Referring to 3 and 5, in the measurement period MP of the first sensing period SP1, the sensing driver 600 may generate the leakage sensing data LSD. According to an embodiment, in the measurement period MP of the first sensing period SP1, the gate signal SS may have an inactivation level, and the sensing signal SSEN may have the activation level. According to an embodiment, in the measurement period MP of the first sensing period SP1, the sensing driver 600 may receive the sensing voltage VSEN of the connection node N0 through the sensing line SL. For example, as shown in FIG. 5, in the measurement period MP of the first sensing period SP1, the switching transistor T2 may be turned off by the gate signal SS having the inactivation level, the transistor T1 may be turned off by the data voltage DV having the off voltage stored in the storage capacitor CST (e.g. the data voltage DV_black corresponding to the black grayscale), the sensing transistor T3 may be turned on by the sensing signal SSEN having the activation level, and the sensing driver 600 may receive a voltage of the connection node N0 through the sensing transistor T3. The sensing voltage VSEN may be substantially the same as the initialization voltage Vinit applied to the connection node N0 in the initialization period IP when the leakage current is not generated. The sensing voltage VSEN may be smaller than the initialization voltage Vinit when the leakage current is generated. Accordingly, the sensing driver 600 may receive the sensing voltage VSEN, that is, the initialization voltage Vinit reduced by the leakage current, from the pixel P through the sensing line SL. Also, the sensing driver 600 may generate the leakage sensing data LSD corresponding to the initialization voltage Vinit reduced by the leakage current. Accordingly, the leakage sensing data LSD may be data for current leakage characteristic.

Referring to FIGS. 3 and 6, according to an embodiment, in the sensing initialization period IP of the second sensing period SP2, the gate signal SS and the sensing signal SSEN may have the activation level. According to an embodiment, in the sensing initialization period IP of the second sensing period SP1, the sensing driver 600 may apply the sensing initialization voltage Vinit to the connection node N0 through the sensing line SL. According to an embodiment, in the second sensing period SP2, the data driver 500 may apply the reference voltage VREF to a gate electrode of the driving transistor T1 through the data line DL. For example, as shown in FIG. 6, in the sensing initialization period IP of the second sensing period SP2, the switching transistor T2 may be turned on by the gate signal SS having the activation level, the reference voltage VREF applied through the data line DL may be written to the storage capacitor CST through the switching transistor T2, the sensing transistor T3 may be turned on by the sensing signal SSEN having the activation level, and the sensing initialization voltage Vinit applied through the sensing line SL may be applied to the connection node NO by the sensing transistor T3.

Referring to FIGS. 3 and 7, in the measurement period MP of the second sensing period SP2, the sensing driver 600 may generate the threshold voltage sensing data VD. According to an embodiment, in the measurement period MP of the second sensing period SP2, the gate signal SS may have an inactivation level and the sensing signal SSEN may have the activation level. According to an embodiment, in the second sensing period SP2, the data driver 500 may apply the reference voltage VREF to the gate electrode of the driving transistor T1 through the data line DL. According to an embodiment, in the measurement period MP of the second sensing period SP2, the data-sensing driver 500 may receive the sensing voltage VSEN of the connection node N0 through the sensing line SL. For example, as shown in FIG. 7, in the measurement period MP of the first sensing period SP1, the switching transistor T2 may be turned on by the gate signal SS having the activation level, the transistor T1 may be turned on by the reference voltage VREF, the sensing transistor T3 may be turned on by the sensing signal SSEN having the activation level, and the sensing driver 600 may receive a voltage of the connection node N0 through the sensing transistor T3. The sensing voltage VSEN may have a voltage VREF-VTH obtained by subtracting the threshold voltage VTH of the driving transistors T1 from the reference voltage VREF, and the sensing driver 600 may receive the sensing voltage VSEN, that is, the voltage VREF-VTH obtained by subtracting the threshold voltage VTH from the reference voltage VREF, from the pixel P through the sensing line SL. Meanwhile, in the measurement period MP of the second sensing period SP2, a second power voltage ELVSS may be adjusted to have substantially the same voltage level as a first power voltage ELVDD, so that the light emitting element EL may not emit light. Also, the sensing driver 600 may generate the threshold voltage sensing data VD corresponding to a difference between the reference voltage VREF and the threshold voltage VTH. Accordingly, the threshold voltage sensing data VD may be data for the threshold voltage VTH of the driving transistor T1.

According to an embodiment, the second sensing period SP2 may follow the first sensing period SP1. According to an embodiment, the sensing driver 600 may generate the leakage sensing data LSD and then generate the threshold voltage sensing data VD. Accordingly, the driving controller 300 may immediately compensate for the later generated threshold voltage sensing data VD based on the previously generated leakage sensing data LSD.

Figure 8:
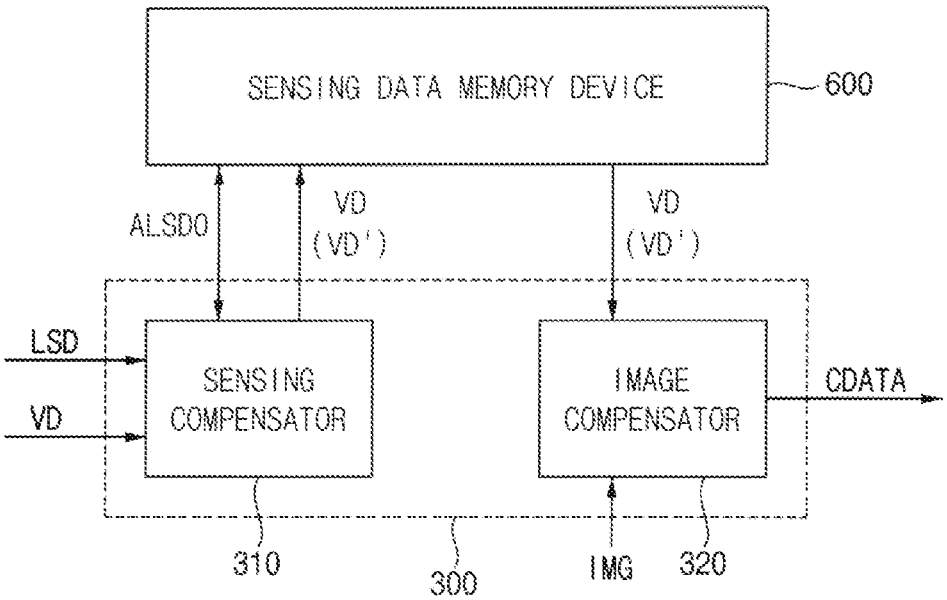
FIG. 8 is a block diagram illustrating an example of a driving controller and a sensing data memory device included in the display device of FIG. 1.

FIG. 8 is a block diagram illustrating an example of the driving controller 300 and the sensing data memory device 700 included in the display device 1000 of FIG. 1.

Referring to FIG. 8, the driving controller 300 may include a sensing compensator 310 and an image compensator 320. The sensing compensator 310 may receive the leakage sensing data LSD, the threshold voltage sensing data VD, and the total average value ALSD0 of the initial leakage sensing data, and compensate for the threshold voltage sensing data based on the leakage sensing data LSD and the total average value ALSD0 of the initial leakage sensing data. The sensing compensator 310 may compensate for the threshold voltage sensing data VD based on the leakage sensing data LSD for the current leakage characteristic of the pixels P, thereby reducing the effect of the leakage current on the threshold voltage sensing data VD. Accordingly, the driving controller 300 may compensate for the input image data IMG based on the compensated threshold voltage sensing data VD', thereby preventing erroneous compensation of the input image data IMG caused by the leakage current.

According to an embodiment, the sensing compensator 310 may write the compensated threshold voltage sensing data VD' in the sensing data memory device 700. According to an embodiment, the sensing compensator 310 may calculate the total average value ALSD0 of the initial leakage sensing data generated when the display device 1000 is manufactured (or before the pixels P is degraded), and write the total average value ALSD0 of the initial leakage sensing data to the sensing data memory device 700. The image compensator 320 may receive the threshold voltage sensing data VD (or VD') stored in the sensing data memory device 700 and compensate for the input image data IMG based on the received threshold voltage sensing data VD (or VD'). The image compensator 320 may compensate for the input image data IMG to generate the compensated image data CDATA. By compensating for the input image data IMG based on the threshold voltage sensing data VD, the data voltage generated based on the compensated image data CDATA may be reflected a threshold voltage VTH of the driving transistor T1 of degraded pixels P. Accordingly, the pixels P may emit light with uniform luminance regardless of a change in the threshold voltage VTH caused by degradation of the driving transistor T1 of the pixels P.

Figure 9:
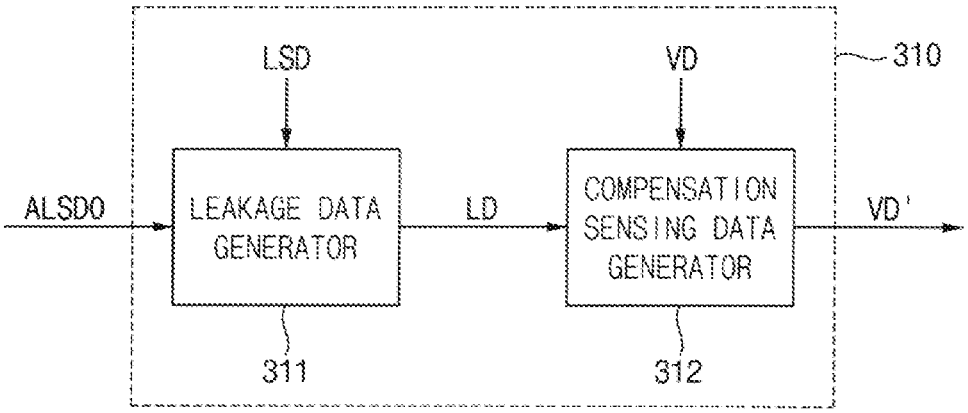
FIG. 9 is a block diagram illustrating an example of a sensing compensator included in the display device of FIG. 1.
Figure 10:
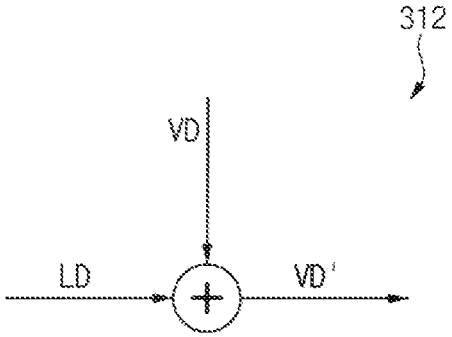
FIG. 10 is a diagram illustrating an example in which the display device of FIG. 1 compensates for threshold voltage sensing data.

FIG. 9 is a block diagram illustrating an example of the sensing compensator 310 included in the display device 1000 of FIG. 1. FIG. 10 is a diagram illustrating an example in which the display device 1000 of FIG. 1 compensates for threshold voltage sensing data VD.

Referring to FIGS. 9 and 10, according to an embodiment, the driving controller 300 may receive the total average value ALSD0 of the initial leakage sensing data, generate the leakage data LD corresponding to a difference between the total average value ALSD0 of the initial leakage sensing data and an individual value of the leakage sensing data LSD for each of the pixels P, and compensate for the threshold voltage sensing data VD based on the leakage data LD. According to an embodiment, the threshold voltage sensing data VD may be compensated by adding an individual value of the leakage data LD for each of the pixels P to an individual value of the threshold voltage sensing data VD for each of the pixels P.

The sensing compensator 310 may include a leakage data generator 311 and a compensation sensing data generator 312. According to an embodiment, the leakage data generator 311 may generate the leakage data LD corresponding to the difference between the total average value ALSD0 of the initial leakage sensing data and the individual value of the leakage sensing data LSD. The compensation sensing data generator 312 may compensate for the threshold voltage sensing data VD based on the leakage data LD to generate the compensated threshold voltage sensing data VD'. According to an embodiment, the compensation sensing data generator 312 may generate the compensated threshold voltage sensing data VD' by adding the individual value of the leakage data LD to the individual value of the threshold voltage sensing data VD. For example, the sensing voltage VSEN received by the sensing driver 600 in the measurement period MP of the second sensing period SP2 may have a lower voltage value when there is the leakage current than when there is no the leakage current. Accordingly, the threshold voltage sensing data VD corresponding to the sensing voltage VSEN received by the sensing driver 600 in the measurement period MP of the second sensing period SP2 may have a lower value when there is the leakage current than when there is no the leakage current. The leakage data LD generated based on the initial leakage sensing data LSD0 and the leakage sensing data LSD may represent a change in the leakage current caused by degradation of the pixels P. The compensation sensing data generator 312 may add the individual value of the leakage data LD to the individual value of the threshold voltage sensing data VD, thereby reducing effect of the leakage current on the threshold voltage sensing data VD.

Figure 11:
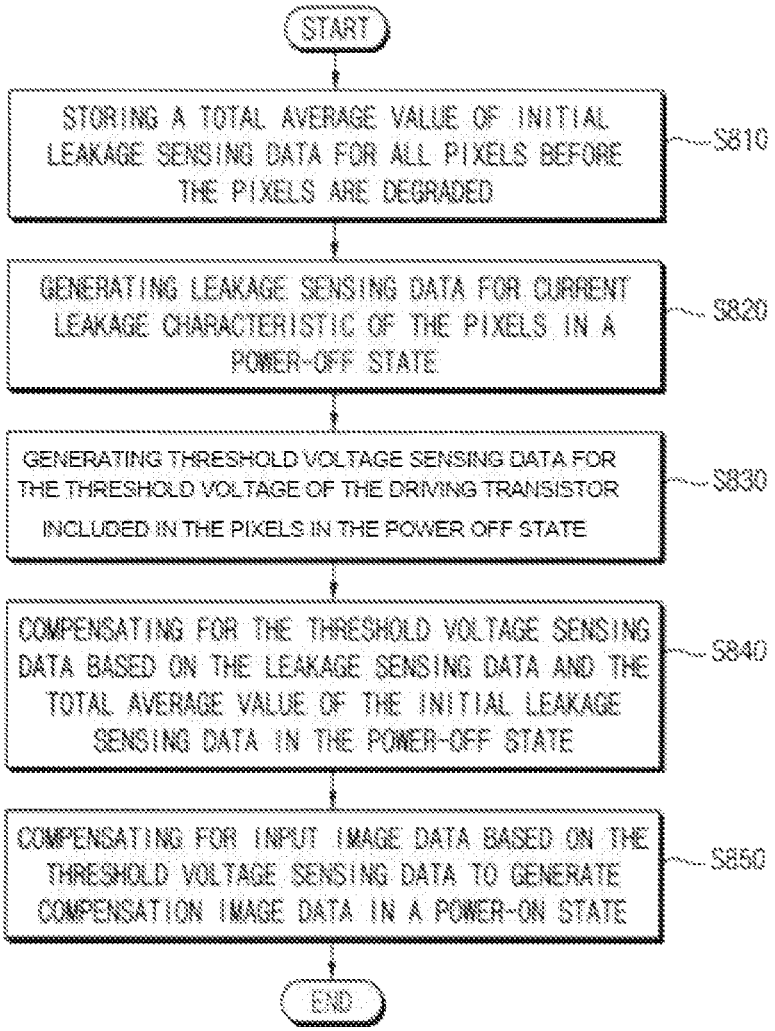
FIGS. 11 and 12 are flowcharts illustrating a method of driving a display device performed by the sensing compensator of FIG. 9.
Figure 12:
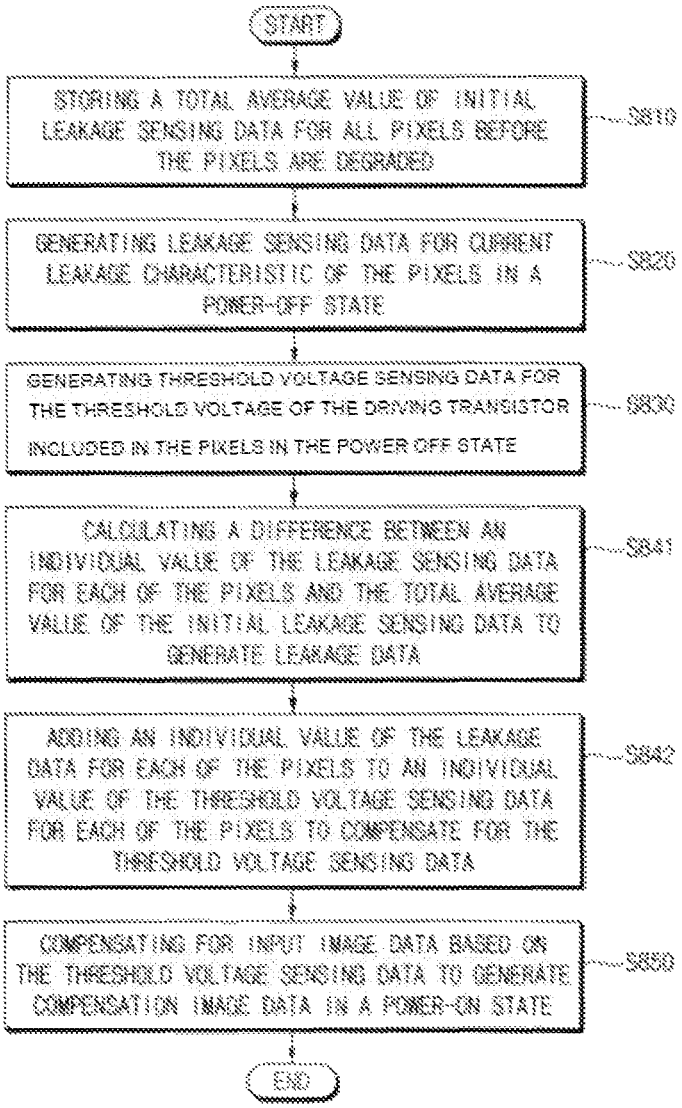

FIGS. 11 and 12 are diagrams illustrating a method of driving the display device performed by the sensing compensator 310 of FIG. 9.

Referring to FIGS. 11 and 12, a method of driving a display device of FIGS. 11 and 12 may store the total average value ALSD0 of the initial leakage sensing data for all of pixels P before the pixels P are degraded (driving S810), generate the leakage sensing data LSD for the current leakage characteristic of the pixels P in the power-off state (driving S820), generate the threshold voltage sensing data VD for the threshold voltage VTH of the driving transistor T1 included in the pixels P in the power-off state (driving S830), compensate for the threshold voltage sensing data VD based on the leakage sensing data LSD and the total average value ALSD0 of the initial leakage sensing data in the power-off state (driving S840), and compensate for the input image data IMG based on the threshold voltage sensing data VD to generate the compensated image data CDATA in a power-on state (driving S850).

Specifically, the method may store the total average value ALSD0 of the initial leakage sensing data for all of pixels P before the pixels P are degraded (driving S810). The initial leakage sensing data LSD0 may mean the leakage sensing data LSD before the pixels P are degraded because the display device is not driven yet, and the total average value ALSD0 of the initial leakage sensing data may mean an average value of the initial leakage sensing data LSD0 for all of the pixels P.

Specifically, the method may generate the leakage sensing data LSD for the current leakage characteristic of the pixels P in the power-off state (driving S820) and generate the threshold voltage sensing data VD for the threshold voltage VTH of the driving transistor T1 included in the pixels P in the power-off state (driving S830). The power-off state may mean a state in which the input image data IMG is not applied to the display device. The display device may generate the leakage sensing data LSD and the threshold voltage sensing data VD while the display panel 100 does not display an image.

Specifically, the method may compensate for the threshold voltage sensing data VD based on the leakage sensing data LSD and the total average value ALSD0 of the initial leakage sensing data in the power-off state (driving S840). The threshold voltage sensing data may be compensated by calculating the difference between the individual value of the leakage sensing data LSD for each of the pixels P and the total average value ALSD0 of the initial leakage sensing data to generate the leakage data LD (driving 841) and adding the individual value of the leakage data LD for each of the pixels P to the individual value of the threshold voltage sensing data VD for each of the pixels P to compensate for the threshold voltage sensing data VD (driving S842). Accordingly, in the method of driving the display device, the leakage data LD representing the difference between the initial leakage sensing data LSD0 and the leakage sensing data LSD for the current leakage characteristic may be added to the threshold voltage sensing data VD, so that the threshold voltage sensing data VD may be compensated for a reduced value caused by the current leakage characteristic.

Specifically, the method may generate the compensation image data CDATA by compensating for the input image data IMG based on the threshold voltage sensing data VD in the power-on state. The power-on state may be a state in which the input image data IMG is applied to the display device. The method may compensate for the input image data IMG based on the threshold voltage sensing data VD, so that the pixels P may emit light with uniform luminance regardless of a change in the threshold voltage VTH caused by degradation of the driving transistor T1 of the pixels P.

Figure 13:
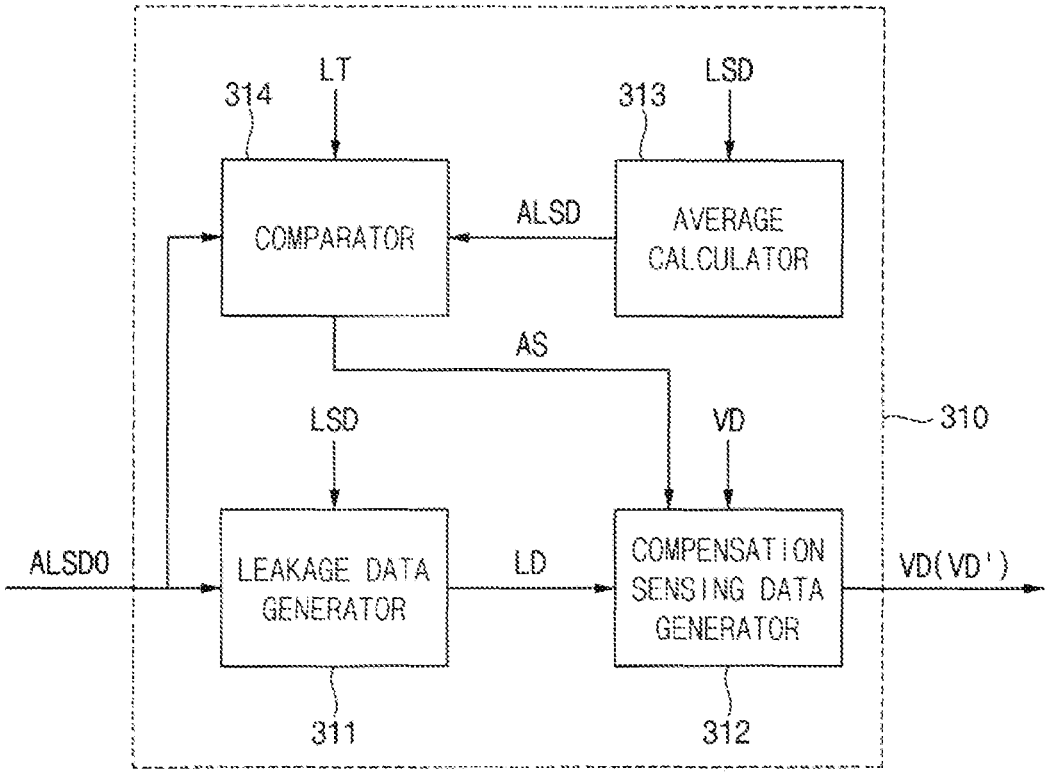
FIG. 13 is a block diagram illustrating another example of a sensing compensator included in the display device of FIG. 1.

FIG. 13 is a block diagram illustrating another example of a sensing compensator 310 included in the display device of FIG. 1.

Referring to FIG. 13, according to an embodiment, the driving controller 300 may receive the total average value ALSD0 of the initial leakage sensing data, generate the leakage data LD corresponding to a difference between the total average value ALSD0 of the initial leakage sensing data and an individual value of the leakage sensing data LSD for each of the pixels P, and compensate for the threshold voltage sensing data VD based on the leakage data LD. According to an embodiment, compensating for the threshold voltage sensing data VD may be performed by adding an individual value of the leakage data LD for each of the pixels P to an individual value of the threshold voltage sensing data VD for each of the pixels P. The driving controller 300 may not compensate for the threshold voltage sensing data VD when a difference between the total average value ALSD0 of the initial leakage sensing data and a total average value ALSD of the leakage sensing data for all of the pixels P is less than a preset reference leakage value LT. The total average value ALSD of the leakage sensing data may be a sum of individual values of the leakage sensing data LSD for each of the pixels P divided by the number of the pixels P.

According to an embodiment, the sensing compensator 310 may include the leakage data generator 311, the compensation sensing data generator 312, an average calculator 313, and comparator 314. According to an embodiment, the leakage data generator 311 may generate the leakage data LD corresponding to the difference between the total average value ALSD0 of the initial leakage sensing data and the individual value of the leakage sensing data LSD. The average calculator 313 may receive the leakage sensing data LSD and calculate the total average value ALSD of the leakage sensing data. The comparator 314 may receive the total average value ALSD0 of the initial leakage sensing data and the total average value ALSD of the leakage sensing data, and calculate the difference between the total average value ALSD0 of the initial leakage sensing data and the total average value ALSD of the leakage sensing data. When the difference between the total average value ALSD of the initial leakage sensing data and the total average value ALSD0 of the initial leakage sensing data is greater than the reference leakage value LT, the comparator 314 may provide an activation signal AS to the compensation sensing data generator 312. When the difference between the total average value ALSD of the initial leakage sensing data and the total average value ALSD0 of the initial leakage sensing data is less than or equal to the preset reference leakage value LT, the comparator 314 may not provide the activation signal AS to the compensation sensing data generator 312. The reference leakage value LT may be set to a level at which it may be considered that compensation of the threshold voltage sensing data VD is not necessary because the leakage current of the pixels P caused by degradation is very small. When the compensation sensing data generator 312 receives the activation signal AS from the comparator 314, the compensation sensing data generator 312 may compensate for the threshold voltage sensing data VD based on the leakage data LD, thereby generating the compensated threshold voltage sensing data VD'. When the compensation sensing data generator 312 does not receive the activation signal AS from the comparator 314, the compensation sensing data generator 312 may apply the threshold voltage sensing data VD to the sensing data memory device 700 as it is. Accordingly, when there is no need to compensate for the threshold voltage sensing data VD because the degradation of the pixels P hardly progresses, compensation is not performed, and thus, unnecessary compensation of the threshold voltage sensing data VD may not be performed. According to an embodiment, when the compensation sensing data generator 312 receives the activation signal AS from the comparator 314, the compensation sensing data generator 312, the compensation sensing data generator 312 may add the individual value of the leakage data LD to the individual value of the threshold voltage sensing data VD to generate the compensated threshold voltage sensing data VD'.

Figure 14:
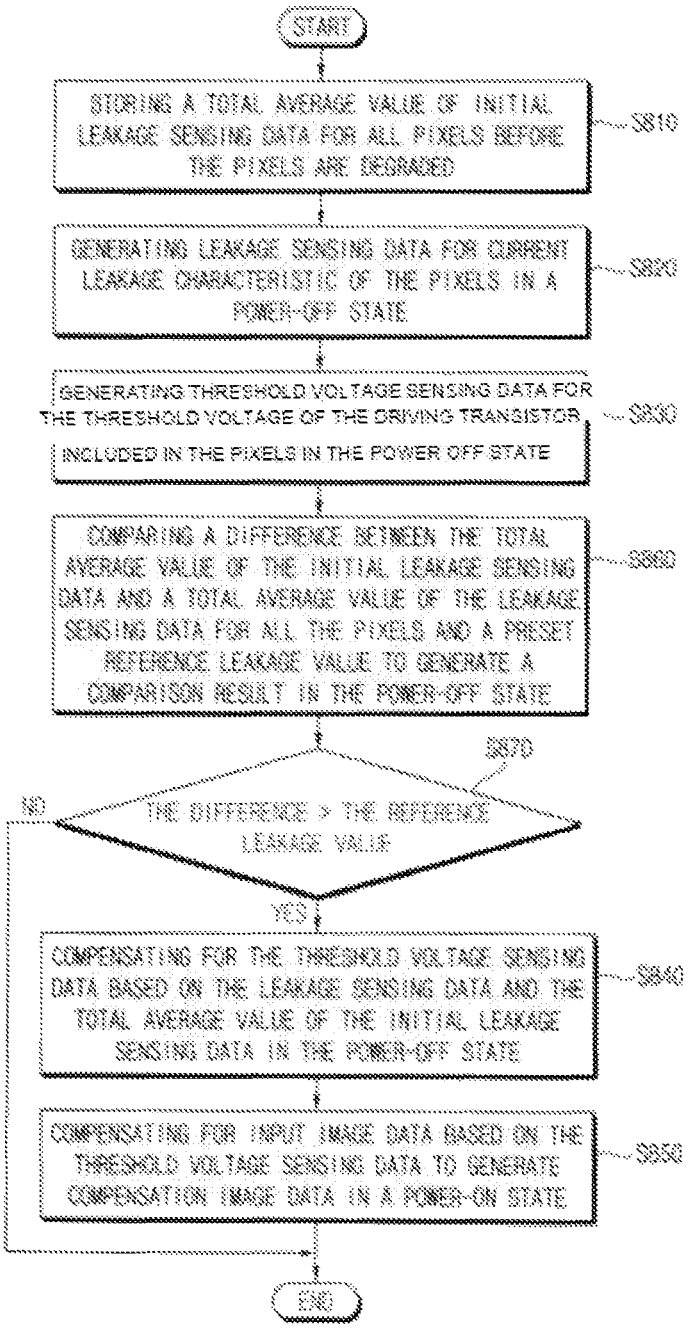
FIG. 14 is a flowchart illustrating a method of driving a display device performed by the sensing compensator of FIG. 13.

FIG. 14 is a diagram illustrating the method of driving the display device performed by the sensing compensator 310 of FIG. 13.

Referring to FIG. 14, the method of driving the display device may store the total average value ALSD0 of the initial leakage sensing data for all of pixels P before the pixels P are degraded (driving S810), generate the leakage sensing data LSD for the current leakage characteristic of the pixels P in the power-off state (driving S820), generate the threshold voltage sensing data VD for the threshold voltage VTH of the driving transistor T1 included in the pixels P in the power-off state (driving S830), compare the difference between the total average value ALSD0 of the initial leakage sensing data and the total average value ALSD of the leakage sensing data for all of the pixels P and the preset reference leakage value LT to generate a comparison result in the power-off state (driving S860), determine whether to compensate for the threshold voltage sensing data VD based on the comparison result (driving S870), compensate for the threshold voltage sensing data VD based on the leakage sensing data LSD and the total average value ALSD0 of the initial leakage sensing data in the power-off state (driving S840), and compensate for the input image data IMG based on the threshold voltage sensing data VD to generate the compensated image data CDATA in a power-on state (driving S850).

Specifically, the method of driving the display device may compare the difference between the total average value ALSD0 of the initial leakage sensing data and the total average value ALSD of the leakage sensing data for all of the pixels P and the preset reference leakage value LT to generate a comparison result in the power-off state (driving S860), determine whether to compensate for the threshold voltage sensing data VD based on the comparison result (driving S870). The method of driving the display device may determine to compensate for the threshold voltage sensing data VD when the difference between the total average value ALSD0 of the initial leakage sensing data and the total average value ALSD of the leakage sensing data is greater than the reference leakage value LT, and determine not to compensate for the threshold voltage sensing data VD when the difference between the total average value ALSD0 of the initial leakage sensing data and the total average value ALSD of the leakage sensing data is less than or equal to the reference leakage value LT. Accordingly, when there is no need to compensate for the threshold voltage sensing data VD because the degradation of the pixels P hardly progresses, compensation is not performed, and thus, unnecessary compensation of the threshold voltage sensing data VD may not be performed.

Figure 15:
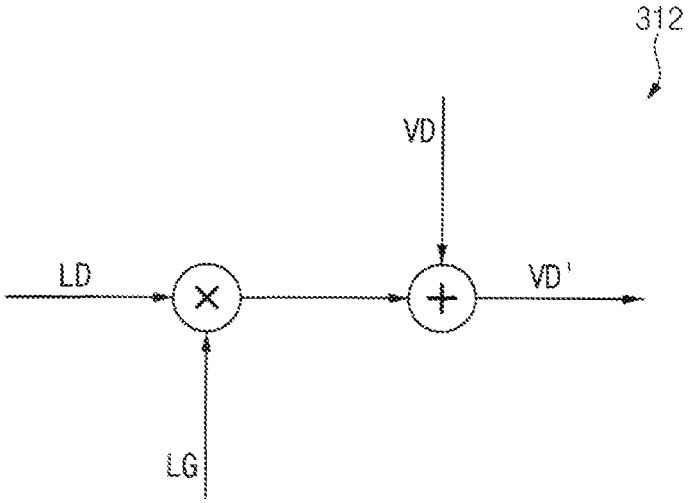
FIG. 15 is a diagram illustrating another example in which the display device of FIG. 1 compensates for threshold voltage sensing data.

FIG. 15 is a diagram illustrating another example in which the display device of FIG. 1 compensates for the threshold voltage sensing data VD.

Referring to FIG. 15, compensating for the threshold voltage sensing data VD may be performed by adding a product of the individual value of the leakage data for each of the pixels P and a leakage gain LG to the individual value of the threshold voltage sensing data VD for each of the pixels P.

Referring to the FIGS. 9 and 15, according to an embodiment, the compensation sensing data generator 312 may generate the compensated threshold voltage sensing data VD' by adding a product of the individual value of the leakage data LD and the leakage gain LG. For example, the sensing voltage VSEN received by the sensing driver 600 in the measurement period MP of the second sensing period SP2 may have a lower voltage value when there is the leakage current than when there is no the leakage current. Accordingly, the threshold voltage sensing data VD corresponding to the sensing voltage VSEN received by the sensing driver 600 in the measurement period MP of the second sensing period SP2 may have a lower value when there is the leakage current than when there is no the leakage current. The leakage data LD generated based on the initial leakage sensing data LSD0 and the leakage sensing data LSD may represent a change in the leakage current caused by degradation of the pixels P. Accordingly, assuming that the leakage sensing data LSD and the threshold voltage sensing data VD are generated under different sensing conditions (e.g. generated based on the sensing voltage VSEN received for different times), the value of the sensing data LSD and the threshold voltage sensing data VD may be different depended on the sensing conditions. Accordingly, in order to constantly compensate for the threshold voltage sensing data VD even when the sensing conditions are different, the compensation sensing data generator 312 may multiply the leakage gain LG by the individual value of the leakage data LD generated based on the leakage sensing data LSD. Accordingly, the compensation sensing data generator 312 may add the product of the individual value of the leakage data LD and the leakage gain LG to the individual value of the threshold voltage sensing data VD, thereby reducing effect of the leakage current on the threshold voltage sensing data VD regardless of the sensing conditions of the threshold voltage sensing data VD and the leakage sensing data LSD.

Figure 16:
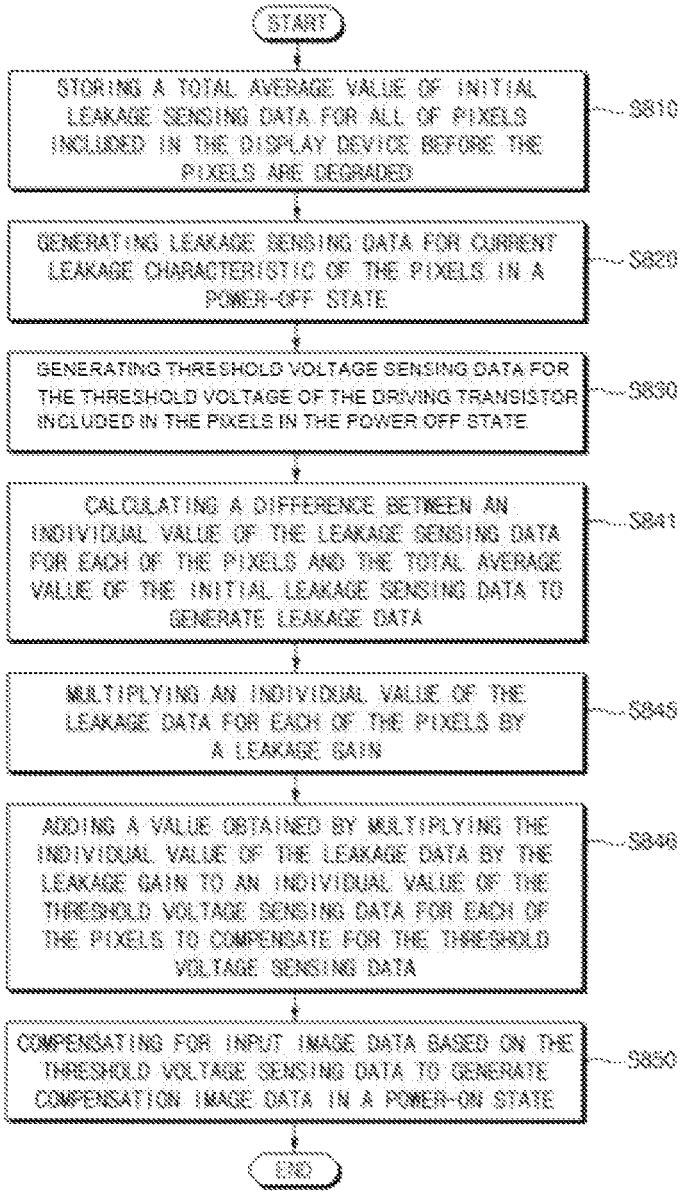
FIG. 16 is a flowchart illustrating a method of driving a display device according to an embodiment of FIG. 15.

FIG. 16 is a flowchart illustrating the method of driving the display device according to the embodiment of FIG. 15.

Referring to FIG. 16, the method of driving display device may store the total average value ALSD0 of the initial leakage sensing data for all of pixels P before the pixels P are degraded (driving S810), generate the leakage sensing data LSD for the current leakage characteristic of the pixels P in the power-off state (driving S820), generate the threshold voltage sensing data VD for the threshold voltage VTH of the driving transistor T1 included in the pixels P in the power-off state (driving S830), compensate for the threshold voltage sensing data VD based on the leakage sensing data LSD and the total average value ALSD0 of the initial leakage sensing data in the power-off state (driving S840), and compensate for the input image data IMG based on the threshold voltage sensing data VD to generate the compensated image data CDATA in a power-on state (driving S850).

Specifically, the method may compensate for the threshold voltage sensing data VD based on the leakage sensing data LSD and the total average value ALSD0 of the initial leakage sensing data in the power-off state (driving S840). Compensating for the threshold voltage sensing data may be performed by calculating the difference between the individual value of the leakage sensing data LSD for each of the pixels P and the total average value ALSD0 of the initial leakage sensing data to generate the leakage data LD (driving 841), multiplying the individual value of the leakage data LD for each of the pixels P by the leakage gain LG (driving S843), and adding a value obtained by multiplying the individual value of the leakage data LD by the leakage gain LG to the individual value of the threshold voltage sensing data VD for each of the pixels P to compensate for the threshold voltage sensing data VD (S844).

Figure 17:
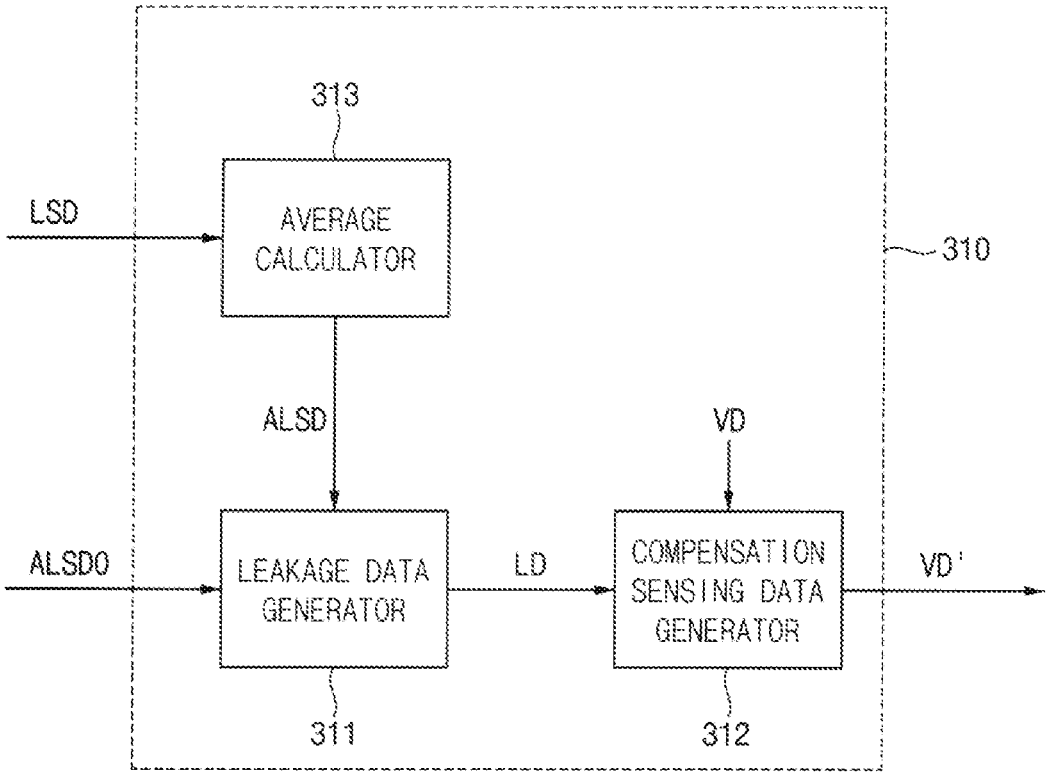
FIG. 17 is a block diagram illustrating another example of a sensing compensator included in the display device of FIG. 1.

FIG. 17 is a block diagram illustrating another example of a sensing compensator 310 included in the display device 1000 of FIG. 1.

Referring to FIG. 17, according to an embodiment, the driving controller 300 may receive the total average value ALSD0 of the initial leakage sensing data, generate the leakage data LD corresponding to the difference between the total average value ALSD0 of the initial leakage sensing data and the total average value ALSD of the leakage sensing data, and compensate for the threshold voltage sensing data VD based on the leakage data LD.

According to an embodiment, the sensing compensator 310 may include the leakage data generator 311, the compensation sensing data generator 312, and the average calculator 313. According to an embodiment, the average calculator 313 may receive the leakage sensing data LSD and calculate the total average value ALSD of the leakage sensing data for all of the pixels P. The leakage data generator 311 may generate the leakage data LD corresponding to the difference between the total average value ALSD0 of the initial leakage sensing data and the total average value ALSD of the leakage sensing data LSD. The compensation sensing data generator 312 may generate the compensated threshold voltage sensing data VD' by adding the individual value of the leakage data LD to the individual value of the threshold voltage sensing data VD. For example, the sensing voltage VSEN received by the sensing driver 600 in the measurement period MP of the second sensing period SP2 may have a lower voltage value when there is the leakage current than when there is no the leakage current. Accordingly, the threshold voltage sensing data VD corresponding to the sensing voltage VSEN received by the sensing driver 600 in the measurement period MP of the second sensing period SP2 may have a lower value when there is the leakage current than when there is no the leakage current. The leakage data LD generated based on the initial leakage sensing data LSD0 and the leakage sensing data LSD may represent a change in the leakage current caused by degradation of the pixels P. The compensation sensing data generator 312 may add the individual value of the leakage data LD to the individual value of the threshold voltage sensing data VD, thereby reducing the effect of the leakage current on the threshold voltage sensing data VD. When only an overall offset occurs without local degradation, generation of the leakage data LD based on the total average value ALSD0 of the initial leakage sensing data and the total average value ALSD of the leakage sensing data may be appropriate.

Figure 18:
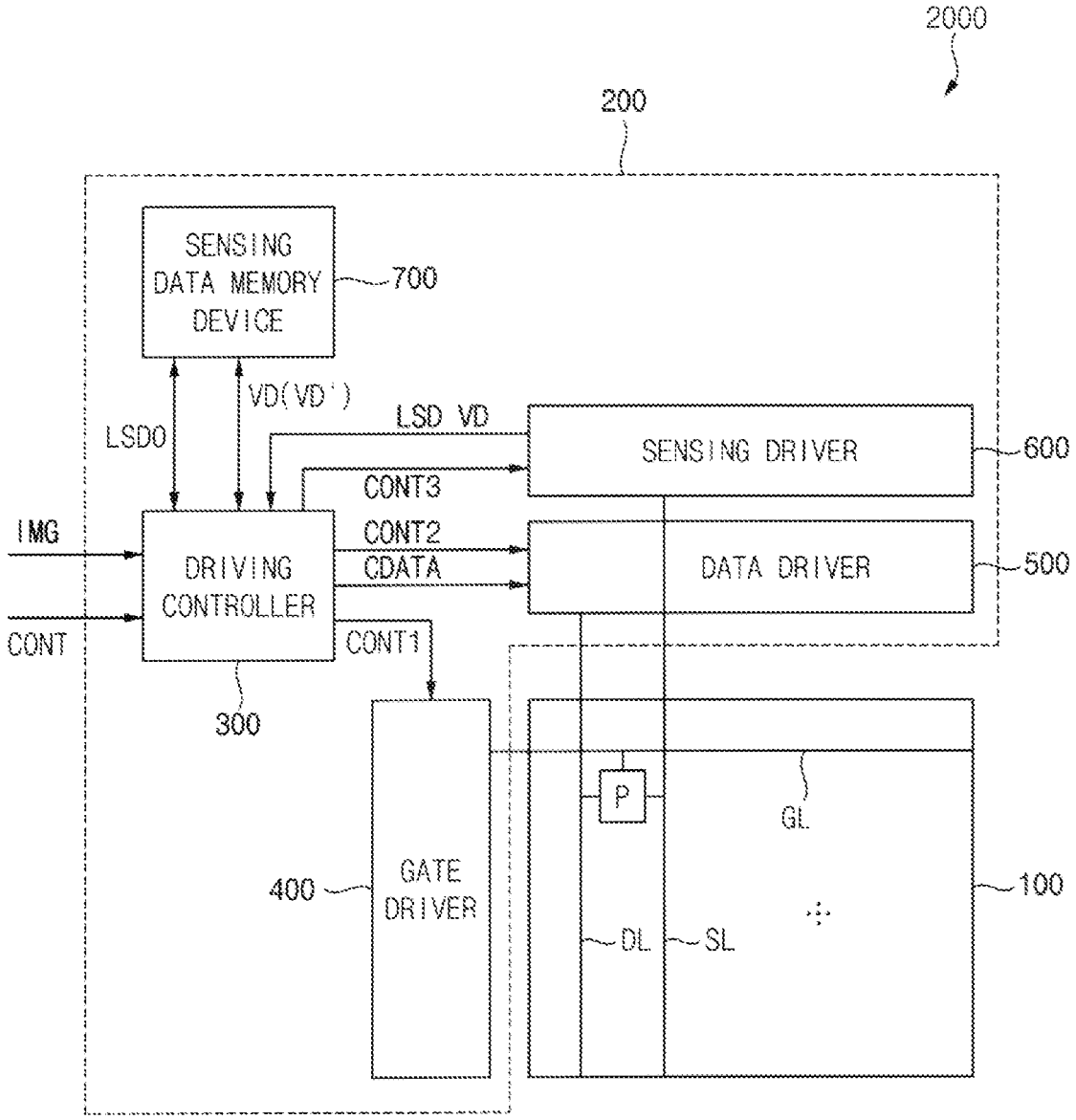
FIG. 18 is a block diagram illustrating a display device according to an embodiment.
Figure 19:
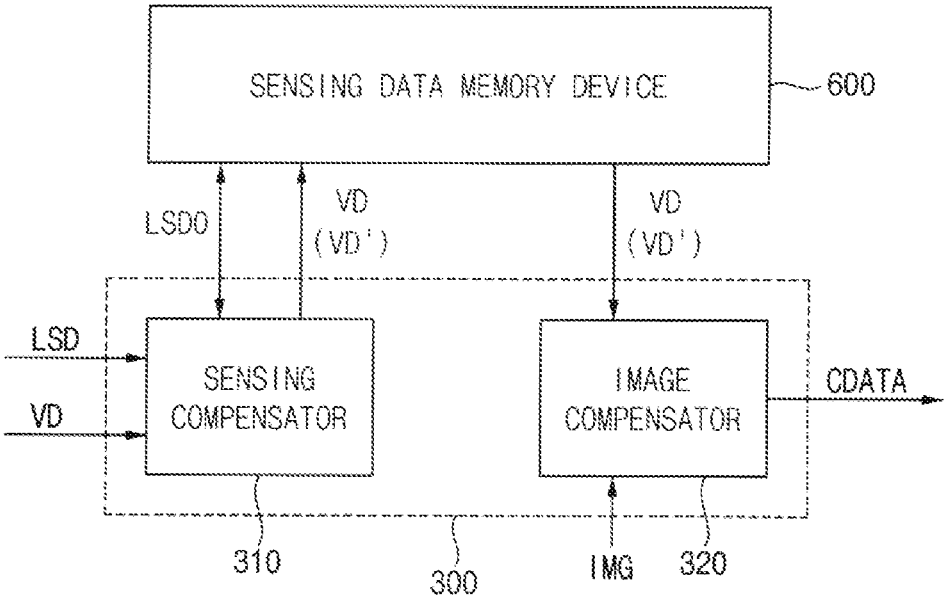
FIG. 19 is a block diagram illustrating an example of a driving controller and a sensing data memory device included in the display device of FIG. 18.

FIG. 18 is a block diagram illustrating a display device 2000 according to an embodiment; FIG. 19 is a block diagram illustrating an example of a driving controller 300 and a sensing data memory device 700 included in the display device 2000 of FIG. 18; and FIG. 20 is a block diagram illustrating an example of a sensing compensator 310 included in the display device 2000 of FIG. 18.

Figure 20:
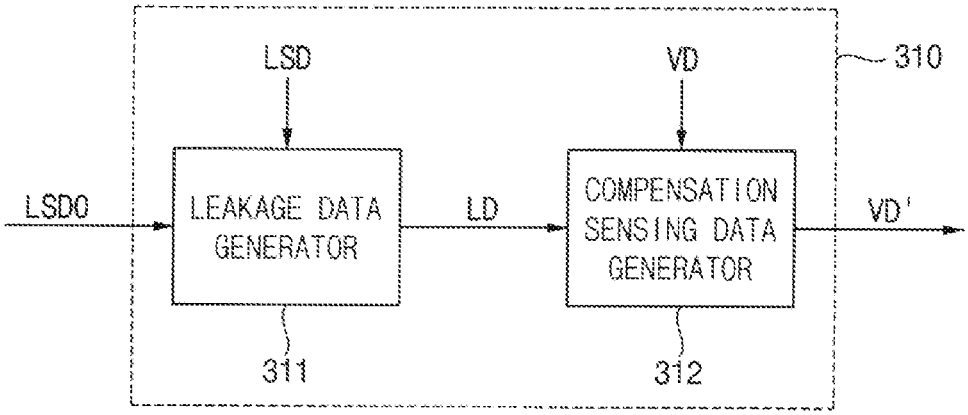
FIG. 20 is a block diagram illustrating an example of a sensing compensator included in the display device of FIG. 18.

Referring to FIGS. 18 to 20, the sensing data memory device 700 of the display device 2000 of FIG. 18 may store the threshold voltage sensing data VD (or VD') and the initial leakage sensing data LSD0. According to an embodiment, the driving controller 300 may write the initial leakage sensing data LSD0 generated when the display device 2000 is manufactured (or before the pixel P is degraded) in the sensing data memory device 700. The driving controller 300 may receive the initial leakage sensing data LSD0, generate the leakage data LD corresponding to the difference between the individual value of the initial leakage sensing data LSD for each the pixels P and the individual value of the leakage sensing data LD for each the pixels P, and compensate for the threshold voltage sensing data VD based on the leakage data LD. Accordingly, the leakage data LD may be generated based on the initial leakage sensing data LSD0 and the current leakage sensing data LSD for one pixel P.

Figure 21:
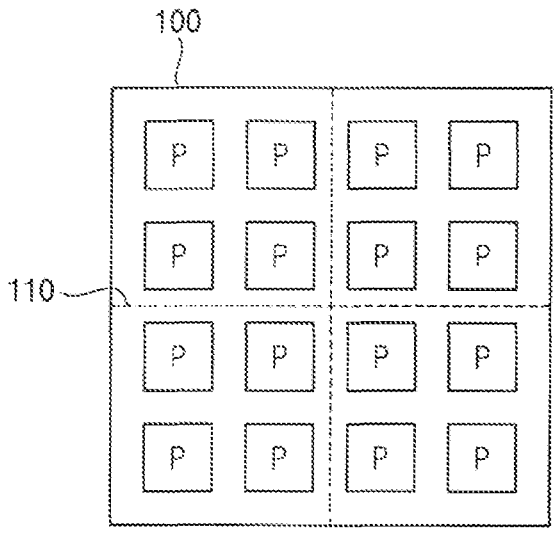
FIG. 21 is a diagram illustrating an example of a display panel included in the display device of FIG. 1.
Figure 22:
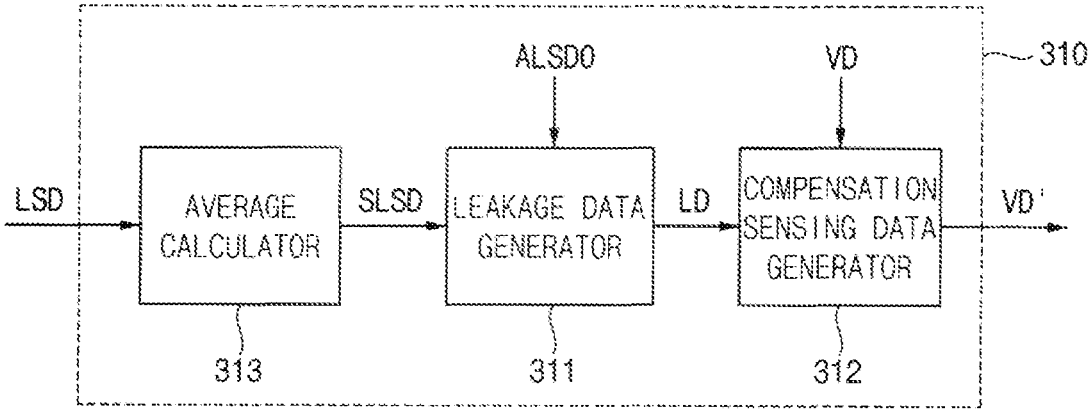
FIG. 22 is a block diagram illustrating another example of a sensing compensator included in the display device of FIG. 1.

FIG. 21 is a diagram illustrating an example of the display panel 100 included in the display device 1000 of FIG. 1 and FIG. 22 is a block diagram illustrating another example of a sensing compensator 310 included in the display device 1000 of FIG. 1.

Referring to FIG. 21, the display panel 100 may include sub-blocks 110. The sub-blocks 110 may divide an area of the display panel 100. In FIG. 20, the sub-blocks 110 are divided such that the pixels P are included by 2×2, but the present inventive concepts are not limited thereto. In addition, the sub-blocks 110 do not necessarily have to be divided into quadrilaterals, and may include any shape.

Referring to FIG. 22, the driving controller 300 may receive the total average value ALSD0 of the initial leakage sensing data, generate the leakage data LD corresponding to a difference between the total average value ALSD0 of the initial leakage sensing data and a sub-block average value SLSD of the leakage sensing data for the pixels P included in each of the sub-blocks 110, and compensate for the threshold voltage sensing data VD based on the leakage data LD. The sub-block average value SLSD of the leakage sensing data may be a sum of individual values of the leakage sensing data LSD for each of the pixels P included in each of the sub-blocks 110 divided by the number of the pixels P included in each of sub-block 110.

The sub-block average value SLSD of the leakage sensing data may be obtained by adding the values of the leakage sensing data LSD for the pixels P included in each of the sub-blocks 110 to the pixels included in each sub-block 110. It may be a value divided by the number of (P).

Referring to FIGS. 21 and 22, according to an embodiment, the sensing compensator 310 may include the leakage data generator 311, the compensation sensing data generator 312, and the average calculator 313. According to an embodiment, the average calculator 313 may receive the leakage sensing data LSD and calculate the sub-block average value SLSD of the leakage sensing data. According to an embodiment, the leakage data generator 311 may generate the leakage data LD corresponding to the difference between the total average value ALSD0 of the initial leakage sensing data and the sub-block average value SLSD of the leakage sensing data. The compensation sensing data generator 312 may compensate for the threshold voltage sensing data VD based on the leakage data LD to generate the compensated threshold voltage sensing data VD'. According to an embodiment, the compensation sensing data generator 312 may add the individual value of the leakage data LD to the individual value of the threshold voltage sensing data VD, thereby generating the compensated threshold voltage sensing data VD'. According to an embodiment, the individual value of the leakage data LD is obtained through interpolation based on the difference between a sub-block average value SLSD0 of the initial leakage sensing data and the sub-block average value SLSD of the leakage sensing data.

Figure 23:
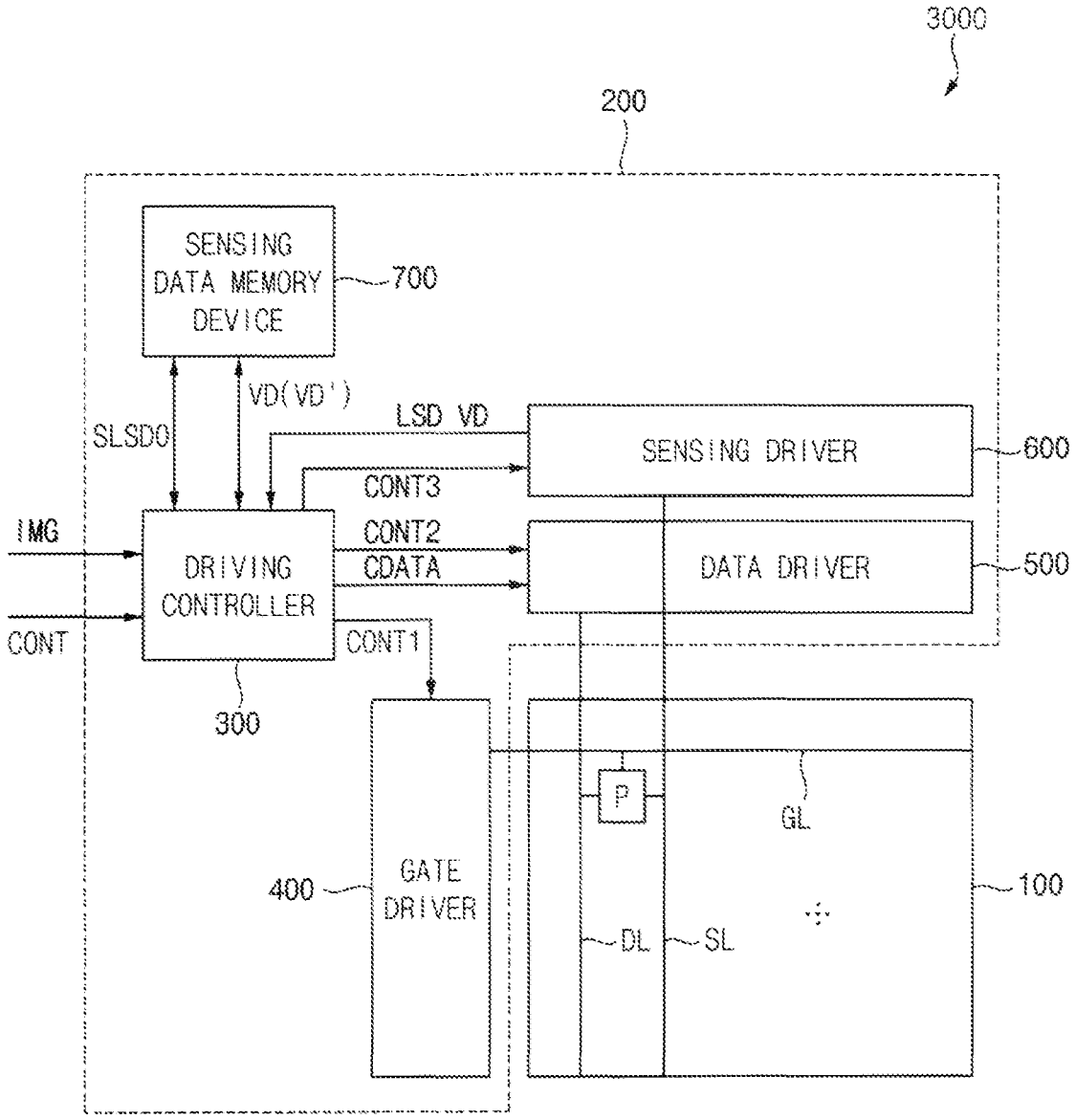
FIG. 23 is a block diagram illustrating a display device according to an embodiment.
Figure 24:
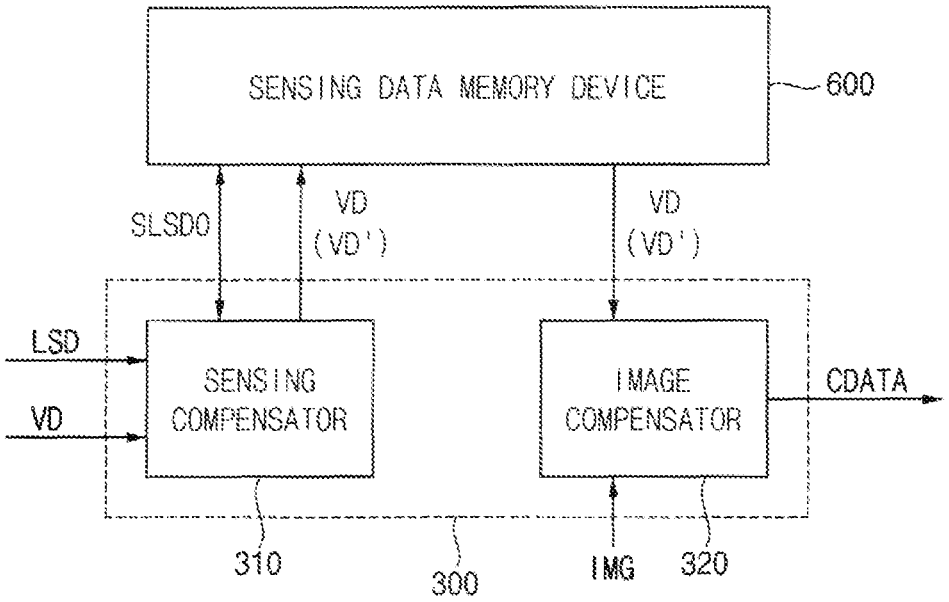
FIG. 24 is a block diagram illustrating an example of a driving controller and a sensing data memory device included in the display device of FIG. 23.
Figure 25:
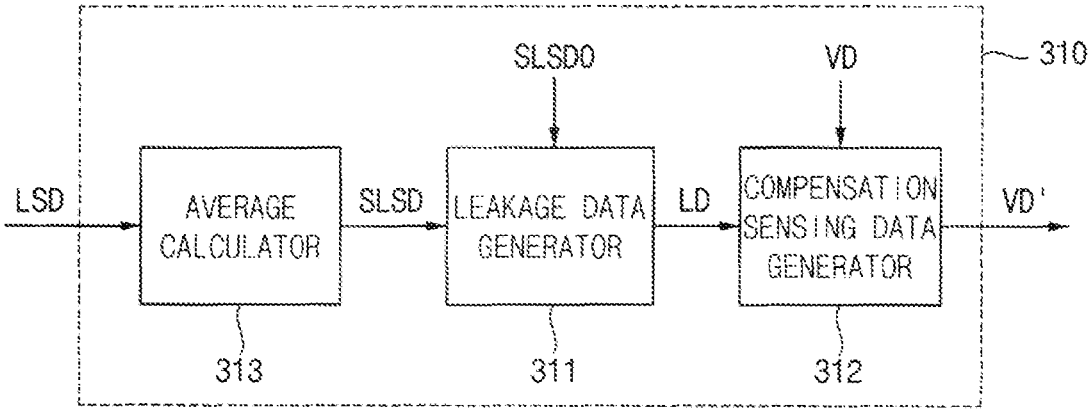
FIG. 25 is a block diagram illustrating an example of a sensing compensator included in the display device of FIG. 23.

FIG. 23 is a block diagram illustrating a display device 3000 according to an embodiment; FIG. 24 is a block diagram illustrating an example of a driving controller 300 and a sensing data memory device 700 included in the display device 3000 of FIG. 23; and FIG. 25 is a block diagram illustrating an example of a sensing compensator 310 included in the display device 3000 of FIG. 23. The display panel 100 included in the display device 3000 of FIG. 23 may include sub-blocks 110.

Referring to FIGS. 23 to 25, the sensing data memory device 700 of the display device 3000 of FIG. 23 may store the threshold voltage sensing data VD (or VD') and the sub-block average value SLSD0 of the initial leakage sensing data. According to an embodiment, the driving controller 300 may write the sub-block average value SLSD0 of the initial leakage sensing data generated when the display device 3000 is manufactured (or before the pixel P is degraded) in the sensing data memory device 700. The sub-block average value SLSD0 of the initial leakage sensing data may be a sum of individual values of the initial leakage sensing data LSD0 for each of the pixels P included in each of the sub-blocks 110 divided by the number of the pixels P included in each of sub-block 110. The driving controller 300 may receive the initial leakage sensing data LSD0, generate the leakage data LD corresponding to the difference between the sub-block average value SLSD0 of the initial leakage sensing data and the sub-block average value SLSD of the leakage sensing data, and compensate for the threshold voltage sensing data VD based on the leakage data LD. For example, in the display panel 100 included in the display device 3000 of FIG. 23, assuming the pixels P are arranged in 4×4, and the pixels P are arranged in 2×2 in the sub-blocks 110 (i.e. the same shape as the display panel 100 of FIG. 20), the sensing data memory device 700 may store 16 data for 16 the pixels when the sensing data memory device 700 stores the initial leakage sensing data LSD0 for each of the pixels P, but the sensing data memory device 700 may store 4 data for 4 the sub-blocks when the sensing data memory device 700 stores the sub-block average value SLSD0 of the initial leakage sensing data. Accordingly, when the sub-block average value SLSD0 of the initial leakage sensing data is stored, the amount of data stored in the sensing data memory device 700 may be reduced. According to an embodiment, the sensing compensator 310 may include the leakage data generator 311, the compensation sensing data generator 312, and the average calculator 313. According to an embodiment, the average calculator 313 may receive the leakage sensing data LSD and calculate the sub-block average value SLSD of the leakage sensing data. According to an embodiment, the average calculator 313 may receive the initial leakage sensing data LSD0 generated when the display device 3000 is manufactured (or before the pixel P is degraded), and generate the sub-block average value SLSD0 of the initial leakage sensing data. According to an embodiment, the leakage data generator 311 may generate the leakage data LD corresponding to the difference between the sub-block average value SLSD0 of the initial leakage sensing data and the sub-block average value SLSD of the leakage sensing data. The compensation sensing data generator 312 may compensate for the threshold voltage sensing data VD based on the leakage data LD to generate the compensated threshold voltage sensing data VD'. According to an embodiment, the compensation sensing data generator 312 may add the individual value of the leakage data LD to the individual value of the threshold voltage sensing data VD, thereby generating the compensated threshold voltage sensing data VD'. According to an embodiment, the individual value of the leakage data LD is obtained through interpolation based on the difference between the sub-block average value SLSD0 of the initial leakage sensing data and the sub-block average value SLSD of the leakage sensing data.

The display device according to embodiments of the present inventive concept may compensate for the threshold voltage sensing data VD based on the leakage sensing data LSD for the current leakage characteristic, thereby compensating for error of the threshold voltage sensing data VD caused by the leakage current. In addition to the threshold voltage sensing data VD for the threshold voltage VTH of the driving transistor T1 of the pixels P, the display device according to the embodiments of the present inventive concept may compensate for mobility sensing data for mobility of the driving transistor T1 of the pixels P based on the leakage sensing data LSD, thereby compensating for error of the mobility sensing data caused by the leakage current. In addition, the display device according to embodiments of the present inventive concept may sense current flowing through the light emitting element EL of the pixels P, and compensate for light emitting element sensing data for driving characteristic of the light emitting element EL to the leakage sensing data LSD, thereby compensating for error of the light emitting element sensing data caused by the leakage current.

The inventive concepts may be applied any electronic device including the display device. For example, the inventive concepts may be applied to a television (TV), a digital TV, a 3D TV, a mobile phone, a smart phone, a tablet computer, a virtual reality (VR) device, a wearable electronic device, a personal computer (PC), a home appliance, a laptop computer, a personal digital assistant (PDA), a portable multimedia player (PMP), a digital camera, a music player, a portable game console, a navigation device, etc.

The foregoing is illustrative of the present inventive concepts and is not to be construed as limiting thereof. Although a few exemplary embodiments of the present inventive concept have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific exemplary embodiments disclosed, and that modifications to the disclosed exemplary embodiments, as well as other exemplary embodiments, are intended to be included within the scope of the appended claims. The present inventive concepts are defined by the following claims, with equivalents of the claims to be included therein.

What is claimed is:

1. A display device comprising: a display panel including pixels; a data driver configured to apply a data voltage to the pixels; a sensing driver configured to receive a sensing voltage from the pixels; a gate driver configured to apply a gate signal to the pixels; and a driving controller configured to control the gate driver, the sensing driver, and the data driver, wherein the sensing driver is configured to generate leakage sensing data for a current leakage characteristic of the pixels based on the sensing voltage received in a first sensing period and to generate threshold voltage sensing data for a threshold voltage of a driving transistor of the pixels based on the sensing voltage received in a second sensing period, wherein the driving controller receives the leakage sensing data and the threshold voltage sensing data from the sensing driver and compensates for the threshold voltage sensing data based on the leakage sensing data.

2. The display device of claim 1, further comprising a sensing data memory device configured to store the threshold voltage sensing data.

3. The display device of claim 2, wherein:

the sensing data memory device stores a total average value of initial leakage sensing data for all of the pixels; and the driving controller receives the total average value of the initial leakage sensing data, generates leakage data corresponding to a difference between the total average value of the initial leakage sensing data and an individual value of the leakage sensing data for each of the pixels, and compensates for the threshold voltage sensing data based on the leakage data.

4. The display device of claim 3, wherein the driving controller does not compensate for the threshold voltage sensing data when a difference between the total average value of the initial leakage sensing data and a total average value of the leakage sensing data for all of the pixels is less than a preset reference leakage value.

5. The display device of claim 3, wherein the threshold voltage sensing data is compensated by adding an individual value of the leakage data for each of the pixels to an individual value of the threshold voltage sensing data for each of the pixels.

6. The display device of claim 3, wherein the threshold voltage sensing data is compensated by adding a product of an individual value of the leakage data for each of the pixels and a leakage gain to an individual value of the threshold voltage sensing data for each of the pixels.

7. The display device of claim 2, wherein:

the sensing data memory device stores a total value of initial leakage sensing data for all of the pixels; and the driving controller receives the total average value of the initial leakage sensing data, generates leakage data corresponding to a difference between the total average value of the initial leakage sensing data and a total average value of the leakage sensing data for all of the pixels, and compensates for the threshold voltage sensing data based on the leakage data.

8. The display device of claim 2, wherein:

the sensing data memory device stores initial leakage sensing data; and the driving controller receives the initial leakage sensing data, generates leakage data corresponding to a difference between an individual value of the initial leakage sensing data for each of the pixels and an individual value of the leakage sensing data for each of the pixels, and compensates for the threshold voltage sensing data based on the leakage data.

9. The display device of claim 2, wherein:

the display panel includes sub-blocks;

the sensing data memory device stores a total average value of initial leakage sensing data for all of the pixels; and the driving controller receives the total average value of the initial leakage sensing data, generates leakage data corresponding to a difference between the total average value of the initial leakage sensing data and a sub-block average value of the leakage sensing data for the pixels included in each of the sub-blocks, and compensates for the threshold voltage sensing data based on the leakage data.

10. The display device of claim 2, wherein:

the display panel includes sub-blocks;

the sensing data memory device stores a sub-block average value of initial leakage sensing data for the pixels included in each of the sub-blocks; and the driving controller receives the sub-block average value of the initial leakage sensing data, generates leakage data corresponding to a difference between the sub-block average value of the initial leakage sensing data and a sub-block average value of the leakage sensing data for the pixels included in each of the sub-blocks, and compensates for the threshold voltage sensing data based on the leakage data.

11. The display device of claim 1, wherein each of the pixels comprises:

a switching transistor configured to transmit the data voltage applied through a data line in response to the gate signal;

a storage capacitor configured to store the data voltage transmitted by the switching transistor;

the driving transistor configured to generate a driving current based on the data voltage stored in the storage capacitor;

a light emitting element configured to emit light based on the driving current generated by the driving transistor; and a sensing transistor configured to connect a connection node between the driving transistor and the light emitting element to a sensing line through which the sensing voltage is transmitted in response to a sensing signal.

12. The display device of claim 11, wherein:

the sensing driver applies a sensing initialization voltage to the connection node through the sensing line in a sensing initialization period of the first sensing period; and the sensing driver generates the leakage sensing data in a measurement period of the first sensing period.

13. The display device of claim 12, wherein:

the sensing driver applies a reference voltage to a gate electrode of the driving transistor through the data line in the second sensing period;

the sensing driver applies the sensing initialization voltage to the connection node through the sensing line in a sensing initialization period of the second sensing period; and the sensing driver generates the threshold voltage sensing data in a measurement period of the second sensing period.

14. The display device of claim 13, wherein the second sensing period follows the first sensing period.

15. A method of driving a display device, the method comprising:

storing a total average value of initial leakage sensing data for all of pixels included in the display device before the pixels are degraded;

generating leakage sensing data for a current leakage characteristic of the pixels in a power-off state;

generating threshold voltage sensing data for a threshold voltage of a driving transistor included in the pixels in the power-off state;

compensating for the threshold voltage sensing data based on the leakage sensing data and the total average value of the initial leakage sensing data in the power-off state; and compensating for input image data based on the threshold voltage sensing data to generate compensated image data in a power-on state.

16. The method of claim 15, wherein compensating for the threshold voltage sensing data includes:

calculating a difference between an individual value of the leakage sensing data for each of the pixels and the total average value of the initial leakage sensing data to generate leakage data; and adding an individual value of the leakage data for each of the pixels to an individual value of the threshold voltage sensing data for each of the pixels to compensate for the threshold voltage sensing data.

17. The method of claim 15, further comprising:

comparing a difference between the total average value of the initial leakage sensing data and a total average value of the leakage sensing data for all of the pixels and a preset reference leakage value to generate a comparison result in the power-off state; and determining whether to compensate for the threshold voltage sensing data based on the comparison result.

18. The method of claim 17, wherein determining whether to compensate for the threshold voltage sensing data includes:

determining to compensate for the threshold voltage sensing data when the difference between the total average value of the initial leakage sensing data and the total average value of the leakage sensing data is greater than the reference leakage value; and determining not to compensate for the threshold voltage sensing data when the difference between the total average value of the initial leakage sensing data and the total average value of the leakage sensing data is less than or equal to the reference leakage value.

19. The method of claim 15, wherein compensating for the threshold voltage sensing data includes:

calculating a difference between an individual value of the leakage sensing data for each of the pixels and the total average value of the initial leakage sensing data to generate leakage data;

multiplying an individual value of the leakage data for each of the pixels by a leakage gain; and adding a value obtained by multiplying the individual value of the leakage data by the leakage gain to an individual value of the threshold voltage sensing data for each of the pixels to compensate for the threshold voltage sensing data.

* * * * *